US005724060A

United States Patent [19]

Graham et al.

[11] Patent Number: 5,724,060

[45] Date of Patent: Mar. 3, 1998

[54] MULTIPLEX ADDRESSING OF FERRO-ELECTRIC LIQUID CRYSTAL DISPLAYS

[75] Inventors: Alistair Graham; Jonathan R. Hughes, both of Malvern; Michael John Towler, Oxford, all of United Kingdom

[73] Assignee: The Secretary of State for Defence in Her Britannic Majesty's Government of the United Kingdom of Great Britain and Northern Ireland, Hants, United Kingdom

[21] Appl. No.: 505,200

[22] PCT Filed: Jan. 26, 1994

[86] PCT No.: PCT/GB94/00150

§ 371 Date: Aug. 14, 1995

§ 102(e) Date: Aug. 14, 1995

[87] PCT Pub. No.: WO94/18665

PCT Pub. Date: Aug. 18, 1994

[30] Foreign Application Priority Data

Feb. 15, 1993 [GB] United Kingdom ..... 9302997

[51] Int. Cl.[6] ..... G09G 3/36

[52] U.S. Cl. ..... 345/97

[58] Field of Search ..... 345/97, 96, 94

[56] References Cited

U.S. PATENT DOCUMENTS

| | | | |
|---|---|---|---|
| 4,779,956 | 10/1988 | Nemoto et al. | 345/96 |
| 4,795,239 | 1/1989 | Yamashita | 345/87 |
| 4,893,117 | 1/1990 | Blomley et al. | 345/96 |
| 5,363,225 | 11/1994 | Minamihara et al. | 345/96 |
| 5,381,254 | 1/1995 | Kanbe et al. | 345/96 |
| 5,440,412 | 8/1995 | Mouri et al. | 345/96 |
| 5,543,945 | 8/1996 | Kimura et al. | 349/19 |
| 5,548,303 | 8/1996 | Kanbe et al. | 345/95 |
| 5,576,729 | 11/1996 | Yamazaki et al. | 345/94 |

OTHER PUBLICATIONS

Texas Instruments "Display Driver Circuits" Texas Instruments Japan, Ltd pp. 4–5, 4–15, Oct. 1989.

*Primary Examiner*—Mark R. Powell
*Attorney, Agent, or Firm*—Nixon & Vanderhye P.C.

[57] ABSTRACT

The invention provides a ferro-electric liquid crystal display (FLCDs) with reduced voltages requirements for driver circuits. This enables standard drivers circuits designed to rms address twisted nematic type of displays, to be used for FLCDs. Displays are formed by cells containing smectic liquid crystal material. The cell walls are surface treated and carry e.g. row and column electrodes forming an x,y matrix of addressable display elements. The smectic liquid crystal material switches between two states upon application of a dc pulse of appropriate amplitude, polarity, and time. Addressing waveforms are strobe waveforms, e.g. two pulses of opposite polarity in successive time slots, applied to each row in turn. Data waveforms are, e.g. dc pulses of alternate polarity with each pulse lasting one time slot ts. Two data waveforms are needed to switch between the two states; one data waveform is the inverse of the other. Typically a strobe waveform pulse may be 50 volts. In the invention a voltage reduction waveform (VRW) is added to both strobe and data waveforms. This has the effect of reducing the maximum amplitude of voltage needed by the driver circuits, whilst leaving the resultant voltage appearing at a display element at the same value as if VRW were not used. With a reduced voltage requirement, driver circuits previously used for relatively low voltage menatic material type of displays can be used to switch smectic materials.

6 Claims, 17 Drawing Sheets

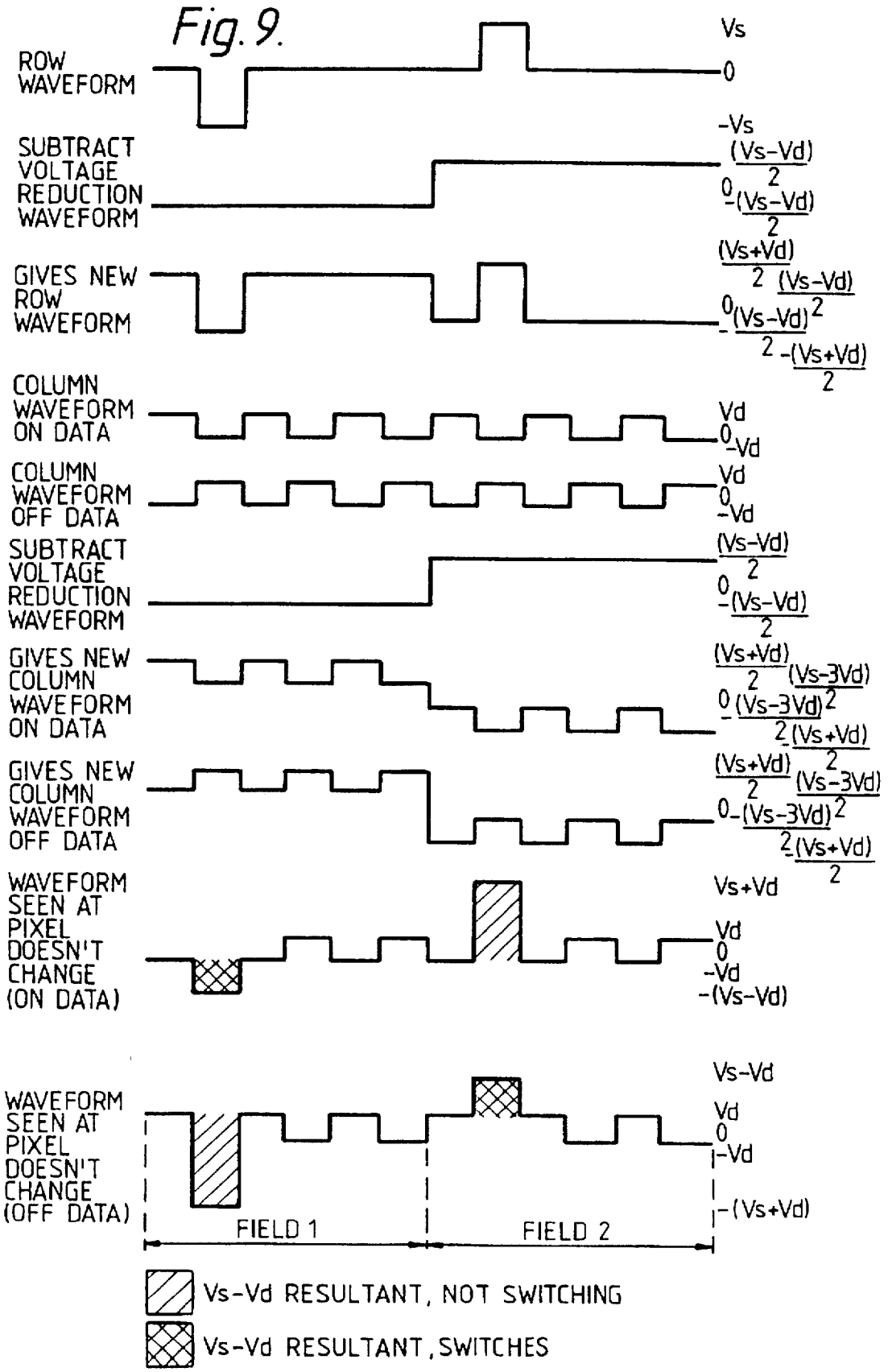
Fig. 9.
ROW WAVEFORM
Vs
0
-Vs
SUBTRACT VOLTAGE REDUCTION WAVEFORM
(Vs-Vd)/2
0
-(Vs-Vd)/2
GIVES NEW ROW WAVEFORM
(Vs+Vd)/2
(Vs-Vd)/2
0
-(Vs-Vd)/2
-(Vs+Vd)/2
COLUMN WAVEFORM ON DATA
Vd
0
-Vd
COLUMN WAVEFORM OFF DATA
Vd
0
-Vd
SUBTRACT VOLTAGE REDUCTION WAVEFORM
(Vs-Vd)/2
0
-(Vs-Vd)/2
GIVES NEW COLUMN WAVEFORM ON DATA
(Vs+Vd)/2
(Vs-3Vd)/2
0
-(Vs-3Vd)/2
-(Vs+Vd)/2
GIVES NEW COLUMN WAVEFORM OFF DATA
(Vs+Vd)/2
(Vs-3Vd)/2
0
-(Vs-3Vd)/2
-(Vs+Vd)/2
WAVEFORM SEEN AT PIXEL DOESN'T CHANGE (ON DATA)
Vs+Vd
Vd
0
-Vd
-(Vs-Vd)
WAVEFORM SEEN AT PIXEL DOESN'T CHANGE (OFF DATA)
Vs-Vd
Vd
0
-Vd
-(Vs+Vd)
FIELD 1
FIELD 2
Vs-Vd RESULTANT, NOT SWITCHING
Vs-Vd RESULTANT, SWITCHES R1
Vs
0
-Vs
ROW N
Vs
0
-Vs
C1
Vd
0
-Vd
C2
Vd
0
-Vd
FIRST FIELD
SECOND FIELD
VRW
(Vs-Vd)/2
0
-(Vs-Vd)/2
LINE ADDRESS TIME
TIME SLOT
R1-VRW
0
(Vs+Vd)/2
(Vs-Vd)/2
-(Vs-Vd)/2
-(Vs+Vd)/2
RN-VRW
0
(Vs+Vd)/2
(Vs-Vd)/2
-(Vs-Vd)/2
-(Vs+Vd)/2
C1-VRW
0
(Vs+Vd)/2
(Vs-3Vd)/2
-(Vs-3Vd)/2
-(Vs+Vd)/2
C2-VRW
0
(Vs+Vd)/2
(Vs-3Vd)/2
-(Vs-3Vd)/2
-(Vs+Vd)/2
R1C1
0
Vs+Vd
Vs-Vd
Vd
-Vd
-(Vs-Vd)
-(Vs+Vd)
Vs AND Vd RESULTANT NOT SWITCHING
RNC2
0
Vs+Vd
Vs-Vd
Vd
-Vd
-(Vs-Vd)
-(Vs+Vd)
Vs AND Vd RESULTANT SWITCHES PIXEL R1
Vs
0
-Vs
RN
Vs
0
-Vs
C1
Vd
0
-Vd
C2
Vd
0
-Vd
VRW
(Vs-Vd)/2
0
-(Vs-Vd)/2
R1-VRW
0
(Vs+Vd)/2
(Vs-Vd)/2
-(Vs-Vd)/2
-(Vs+Vd)/2
RN-VRW
0
(3Vs+Vd)/2
(Vs+Vd)/2
(Vs-Vd)/2
-(Vs-Vd)/2
-(Vs+Vd)/2
-(3Vs+Vd)/2
C1-VRW
0
(Vs+Vd)/2
(Vs-3Vd)/2
-(Vs-3Vd)/2
-(Vs+Vd)/2
C2-VRW
0
(Vs+Vd)/2
(Vs-3Vd)/2
-(Vs-3Vd)/2
-(Vs+Vd)/2
R1C1
0
Vs+Vd
Vs-Vd
Vd
-Vd
-(Vs-Vd)
-(Vs+Vd)
FIELD 1
FIELD 2
Vs+Vd RESULTANT NOT SWITCHING
Vs-Vd RESULTANT SWITCHES

MULTIPLEX ADDRESSING OF FERRO-ELECTRIC LIQUID CRYSTAL DISPLAYS

BACKGROUND OF THE INVENTION

1. Field of the Invention

This invention relates to the multiplex addressing of ferroelectric liquid crystal displays (FLCDs). Such displays may use a chiral smectic C, I, and F liquid crystal material.

2. Discussion of Prior Art

Liquid crystal display devices commonly comprise a thin layer of a liquid crystal material contained between two glass slides. Electrode structures on the inner faces of these slides enable an electric field to be applied across the liquid crystal layer thereby changing its molecular alignment. Many different types of displays have been made using nematic and cholesteric liquid crystal material. Both these types of material are operated between an electric field ON state and a field OFF state; i.e. displays are operated by switching an electric field ON and OFF Both nematic and cholesteric material respond to the rms value of applied electric field; they are not polarity sensitive.

A more recent type of display uses a ferroelectric chiral smectic C, I, and F liquid crystal material in which liquid crystal molecules adopt one of two possible field ON states depending on the polarity of applied field. These displays are thus switched between the two states by dc pulses of appropriate polarity. In a zero applied field the molecules may adopt an intermediate, configuration depending upon surface alignment treatment. Chiral smectic displays offer very fast switching together with an amount of bistability which depends upon material, liquid crystal material layer thickness, and cell surface alignment processes. Examples of chiral smectic displays are described in G.B. No. 2,163,273; G.B. No. 2,159,635; G.B. No. 2,166,256; G.B. No. 2,157,451; U.S. Pat. No. 4,536,059; U.S. Pat. No. 4,367,924; G.B. P.A. No 86/08,114 - GB 2,209,610 - P.C.T. No. G.B. 87/00,222; G.B. P.A. No 86/08,115 - GB 2,210,468 - P.C.T. No 87/00,221; G.B. P.A. No. 86/08,116 - GB 2,210,469 - P.C.T. 87/00,220.

One known display is formed as an x, y matrix of pixels or display elements produced at the intersections between column electrodes on one wall and row electrodes on the other wall. The display is addressed in a multiplex manner by applying voltages to successive row (x) and column (y) electrodes.

There are a number of known systems for multiplex addressing chiral smectic displays; see for example article by Harada et al 1985 S.I.D. Paper 8.4 pp 131–134, and Lagerwall et al 1985 I.D.R.C. pp 213–221. See also GB 2,173,336-A and GB 2,173,629-A. Multiplex addressing schemes for FLCDs employ a strobe waveform that is applied in sequence down eg a row of electrodes simultaneously with data waveforms applied to eg column electrodes. A characteristic of FLCDs is that they switch on receipt of a pulse of suitable voltage amplitude and length of time of application, ie pulse width, termed a voltage time product V.t. Thus both amplitude and pulse width need to be considered in designing multiplex addressing schemes. To address a large display in a relatively short time requires short pulse widths and a correspondingly high voltage. In a typical display cell the pulse width is 50 to 100 μsec and voltages up to 50 volts need to be switched through drivers circuits to a display.

At present the circuitry for driving a large number of electrodes in a display exists for multiplex addressed nematic devices such as the 90° twisted nematic and the 270° super twisted nematic with their relatively low voltage switching requirements, eg peak voltages of +/−25 volts; see for example H Kawakami, Y Nagae, and E Kaneko, SID Conference Proceedings 1976 pages 50–52. Circuitry capable of handling larger voltage levels are only available with about 64 outputs per circuit chip. Large displays require well over 100 outputs per chip. There is therefore a problem in addressing large FLCD because of the dual requirement to handle large voltage levels and provide a large number of outputs connections.

SUMMARY OF THE INVENTION

An object of the present invention is to reduce the voltage levels required by multiplex driving circuits to address FLCDs.

The above problem is solved according to this invention, by adding an additional waveform to both strobe and data waveforms used to address a FLCD whilst still maintaining a resultant voltage on the material sufficient to cause switching. This allows existing multiplex addressing drive chips designed for low voltage rms addressed displays to be used for multiplex addressing FLCDs.

According to this invention a method of multiplex addressing a ferroelectric liquid crystal display formed by the intersections of an m set of electrodes and an n set of electrodes to provide an m x n matrix of addressable display elements comprises the steps of:

generating row and column waveforms comprising voltage pulses of differing dc amplitude and sign in successive time slots (ts) for applying to the m and n sets of electrodes;

multiplex addressing the m and n set of electrodes with the row and column waveforms applied through driver circuits to address each display element;

characterised by the step of modifying both row and column waveforms by a voltage reduction waveform, whereby the voltage levels required by the driver circuits are reduced whilst maintaining a sufficient voltage amplitude at display elements to cause switching.

According to this invention a multiplex addressed liquid crystal display comprises:

a liquid crystal cell including a layer of ferro-electric smectic liquid crystal material contained between two walls each bearing a set of electrodes arranged to form collectively a matrix of addressable display elements;

driver circuits for applying data waveforms to one set of electrodes and strobe waveforms to the other set of electrodes in a multiplexed manner, waveform generators for generating data and strobe waveforms of unipolar pulses in sucessive time slots (ts) for applying to the driver circuits, means for controlling the order of data waveforms so that a desired display patern is obtained, characterised by:

means for modifying the data and strobe waveforms so that voltage levels applied to the driver circuits are reduced whilst maintaining the resultant voltage level appearing at the addressable intersections.

The unipolar pulses are substantially dc pulses of required amplitude and polarity, each lasting for one time slot (ts).

BRIEF DESCRIPTION OF THE DRAWINGS

One form of the invention will now be described, by way of example only, with reference to the accompanying drawings in which:

FIGS. 8 to 12, and 14 to 20 are waveform diagrams showing the invention applied to different addressing systems;

DETAILED DISCUSSION OF PREFERRED EMBODIMENTS

Figure 1:
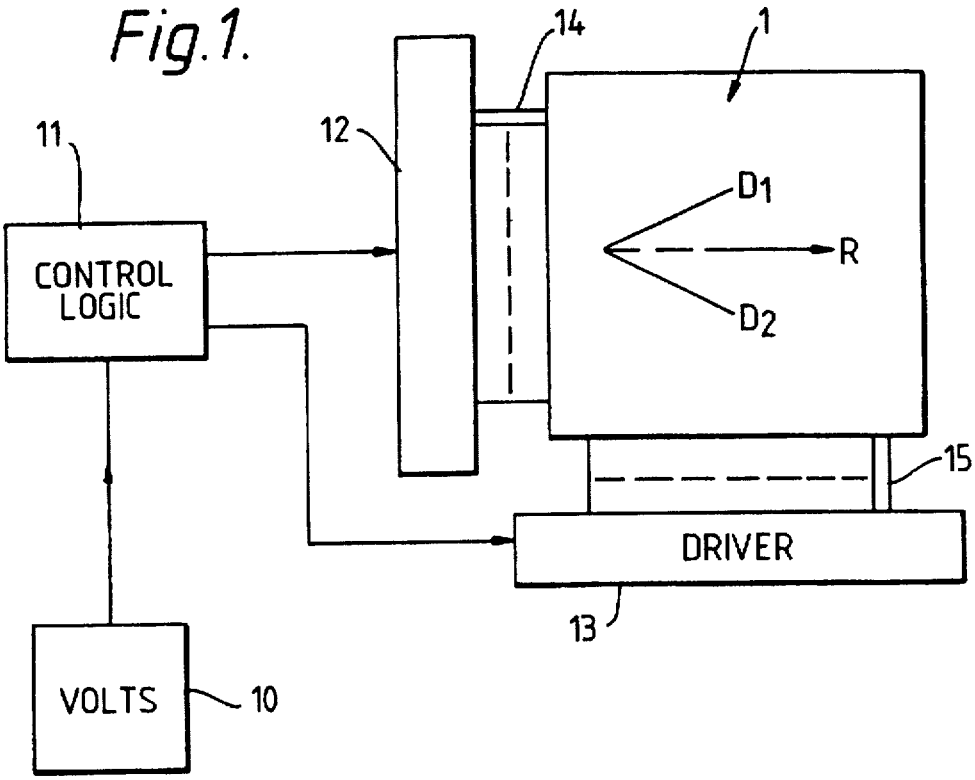
FIGS. 1, 2, are plan and section views of a liquid crystal display device.
Figure 2:
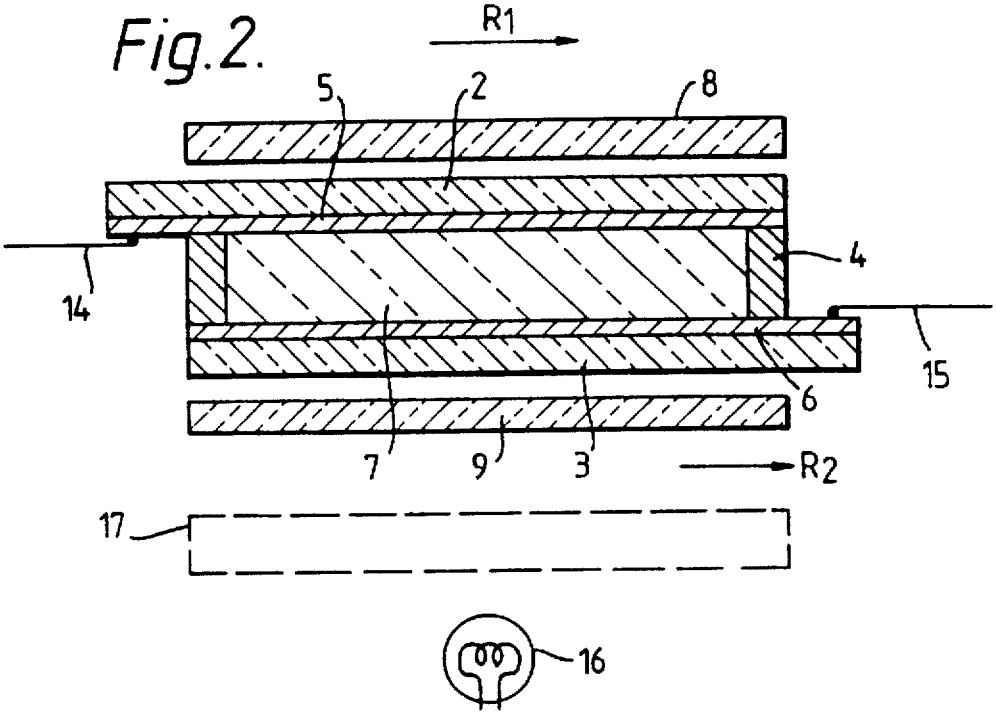

The cell 1 shown in FIGS. 1, 2 comprises two glass walls, 2, 3, spaced about 1–6 μm apart by a spacer ring 4 and/or distributed spacers. Electrode structures 5, 6 of transparent tin oxide are formed on the inner face of both walls. These electrodes may be of conventional row (x) and column (y) shape, seven segment, or an r-O display. A layer 7 of liquid crystal material is contained between the walls 2, 3 and spacer ring 4. Polarisers 8, 9 are arranged in front of and behind the cell 1. The alignment of the optical axis of the polarisers 8, 9 are arranged to maximise contrast of the display; ie approximately crossed polarisers with one optical axis along one switched molecular direction. A d.c. voltage source 10 supplies power through control logic 11 to driver circuits 12, 13 connected to the electrode structures 5, 6, by lead wires 14, 15.

The device may operate in a transmissive or reflective mode. In the former light passing through the device e.g. from a tungsten bulb 16 is selectively transmitted or blocked to form the desired display. In the reflective mode a mirror 17 is placed behind the second polariser 9 to reflect ambient light back through the cell 1 and two polarisers. By making the mirror 17 partly reflecting the device may be operated both in a transmissive and reflective mode with one or two polarisers.

Prior to assembly the walls 2, 3 are surface treated by spinning on a thin layer of a polymer such as a polyamide or polyimide, drying and where appropriate curing; then buffing with a soft cloth (e.g. rayon) in a single direction R1, R2. This known treatment provides a surface alignment for liquid crystal molecules. The molecules (as measured in the nematic phase) align themselves along the rubbing direction R1, R2, and at an angle of about 0° to 15° to the surface depending upon the polymer used and its subsequent treatment; see article by S Kuniyasu et al, Japanese J of Applied Physics vol 27, No 5, May 1988, pp827–829. Alternatively surface alignment may be provided by the known process of obliquely evaporating eg. silicon monoxide onto the cell walls.

Figure 3:
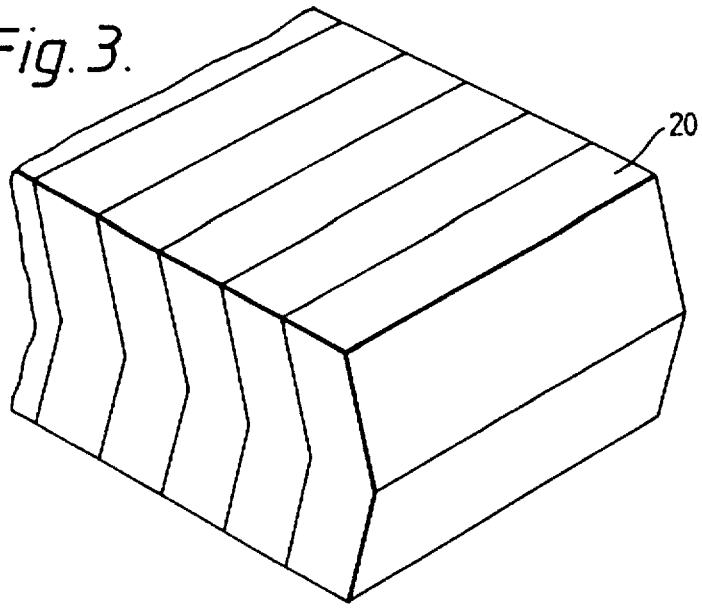
FIG. 3 is a stylised perspective view of a layer of aligned liquid crystal material showing a chevron type of molecular layer alignment.
Figure 4:
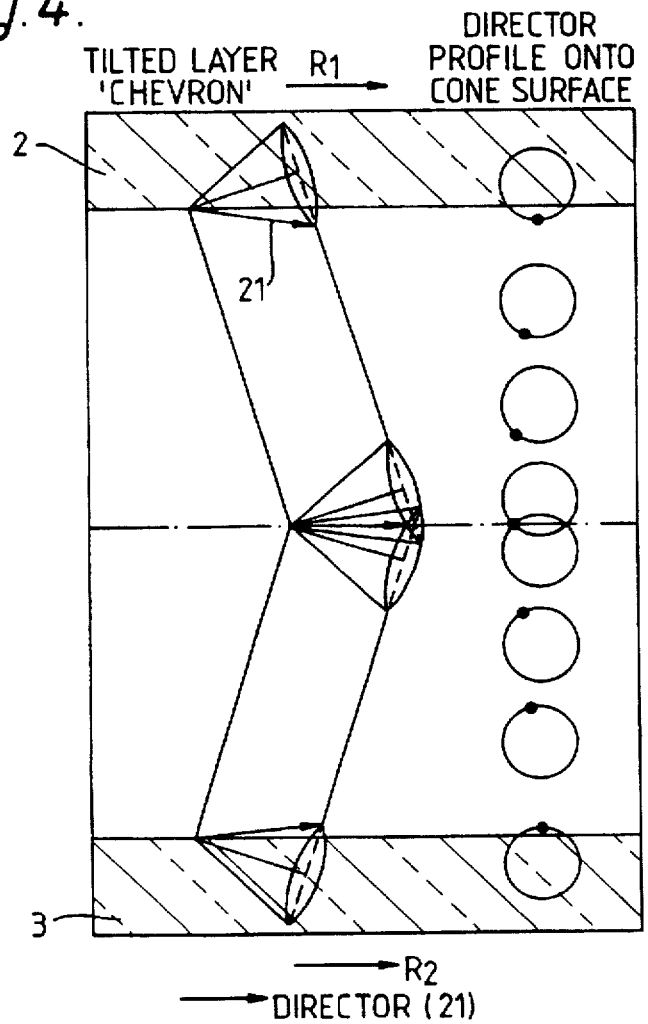
FIG. 4 is a stylised sectional view of part of FIG. 3 to a larger scale, one of several possible director profiles possible with the chevron structure.

The surface alignment treatment provides an anchoring force to adjacent liquid crystal materials molecules. Between the cell walls the molecules are constrained by elastic forces characteristic of the material used. The material forms itself into molecular layers 20 each parallel to one another as shown in FIGS. 3, 4, which are specific examples of many possible structures. The Sc is a tilted phase in which the director lies at an angle to the layer normal, hence each molecular director 21 can be envisaged as tending to lie along the surface of a cone, with the position on the cone varying across the layer thickness, hence the chevron appearance of each macro layer 20.

Considering the material adjacent the layer centre, the molecular director 21 lies approximately in the plane of the layer. Application of a dc voltage pulse of appropriate sign will move the director along the cone surface to the opposite side of the cone. The two positions D1, D2 on this cone surface represent two stable states of the liquid crystal director, ie the material will stay in either of these positions D1, D2 on removal of applied electric voltage.

In practical displays the director may move from these idealised positions. It is common practice to apply an ac bias to the material at all times when information is to be displayed. This ac bias has the effect of moving the director and can improve display appearance. The effect of ac bias is described for example in Proc 4th IDRC 1984 pp 217–220. Display addressing scheme using ac bias are described eg in GB patent application number 90.17316.2, PCT/GB 91/01265, J R Hughes and E P Raynes. The ac bias may be data waveforms applied to the column electrodes 15.

Suitable materials include catalogue references BDH-SCE 8, ZLI-5014-000, available from Merck Darmstadt, and those listed in PCT/GB88/01004, WO 89/05025, and:

19.6% CM8(49% CC1 + 51% CC4) + 80.4% $H_1$

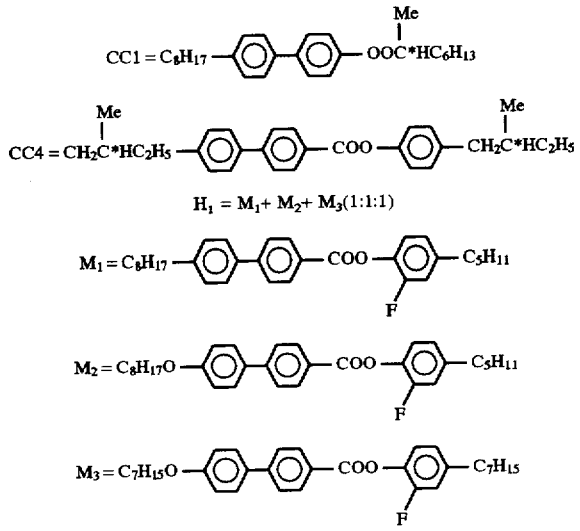

Another mixture is LPM 68=H1 (49.5%), AS 100 (49.5%), IGS 97 (1%)

H1 = MB 8.5F + MB 80.5F + MB 70.7F(1:1:1)

AS100 = PYR 7.09 + PYR 9.09(1:2)

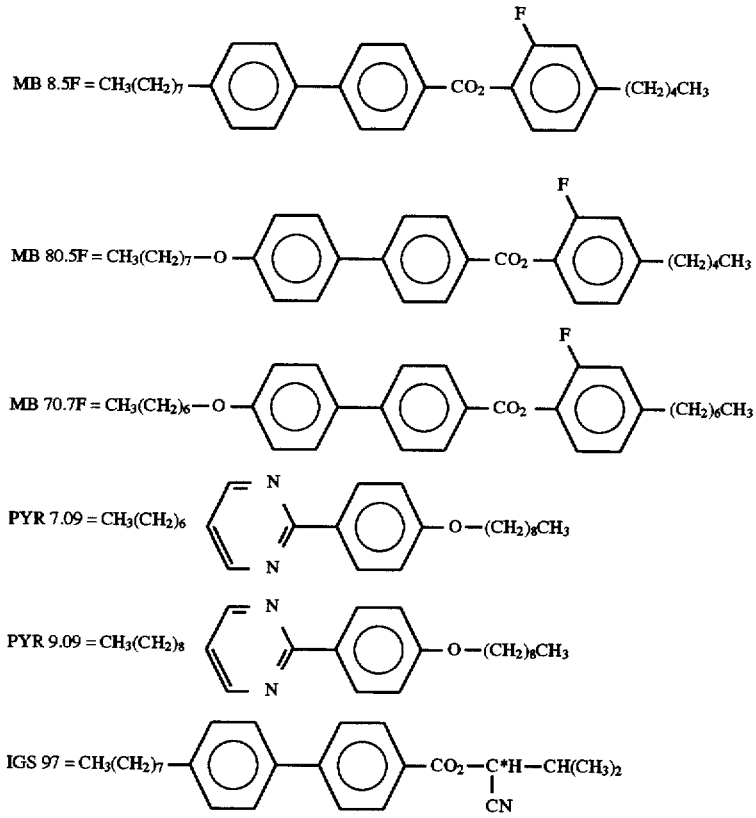

Figure 5:
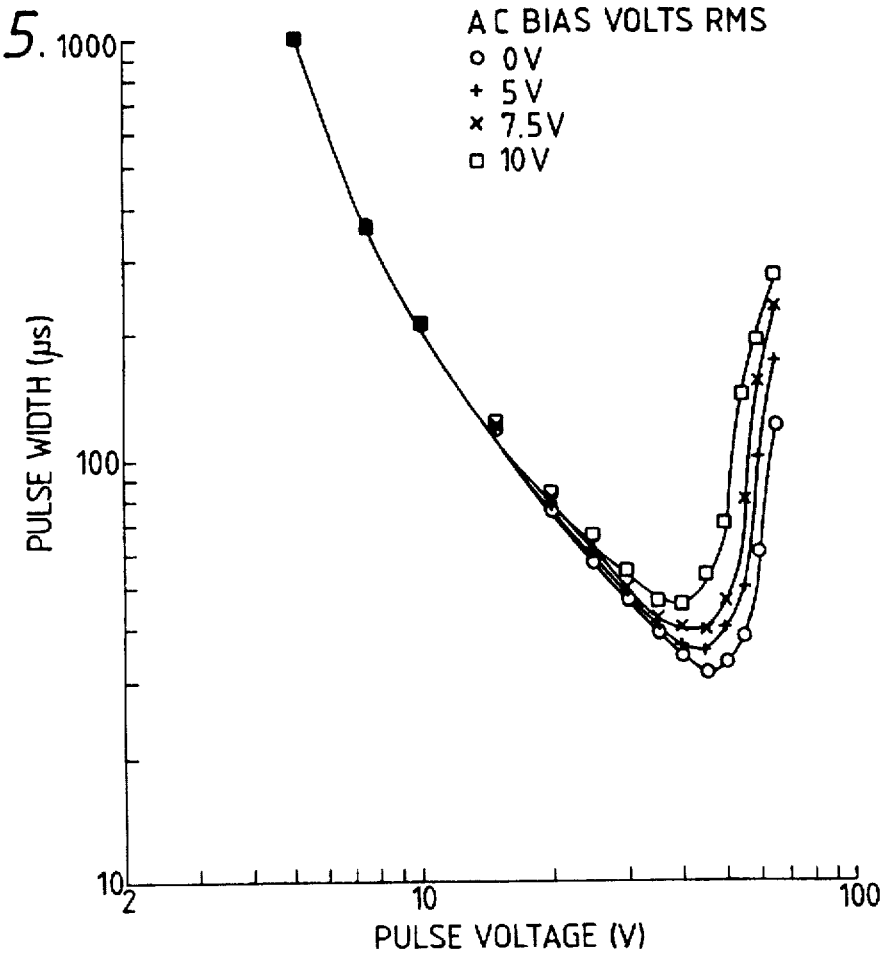
FIG. 5 is a graph of applied voltage pulse width against voltage amplitude, showing switching characteristics for different amounts of applied ac bias for a material showing a voltage time (v.t) minimum.

The switching characteristic of pulse width against applied voltage for one material LPM68 in a layer 1.7 μm thick at 20° C. is shown in FIG. 5. For values of voltage time products (v.t) in the area below the curves the liquid crystal material will not switch. For v.t products above the lines the material will switch. As shown the curve varies somewhat with the level of a.c bias applied; this is described later. Also the curves vary with the relative amplitude values of two strobe pulses as described in WO 89/05025. Thus in determining switching characteristics for a given material, the product v.t, the shape of resultant waveforms of a pixel, the amount of a.c bias, and the material temperature must be taken into account. Some liquid crystal materials have differently shaped v.t characteristics. For example some materials do not show the minimum seen in FIG. 5, but merely a decreasing curve of pulse width with increasing voltage.

For maximum contrast in most two polariser devices, it is desirable for the apparent cone angle, or the angle between the director in the two switched states to be about 45°. One of the polarisers is aligned parallel to one of the two switched director positions; the second polariser is aligned perpendicular to the first polariser. Alternatively, as described in GB 9127316, and PCT/GB 9202368 the polarisers may be rotated from the crossed position to improve contrast between the two switched states.

Figure 7:
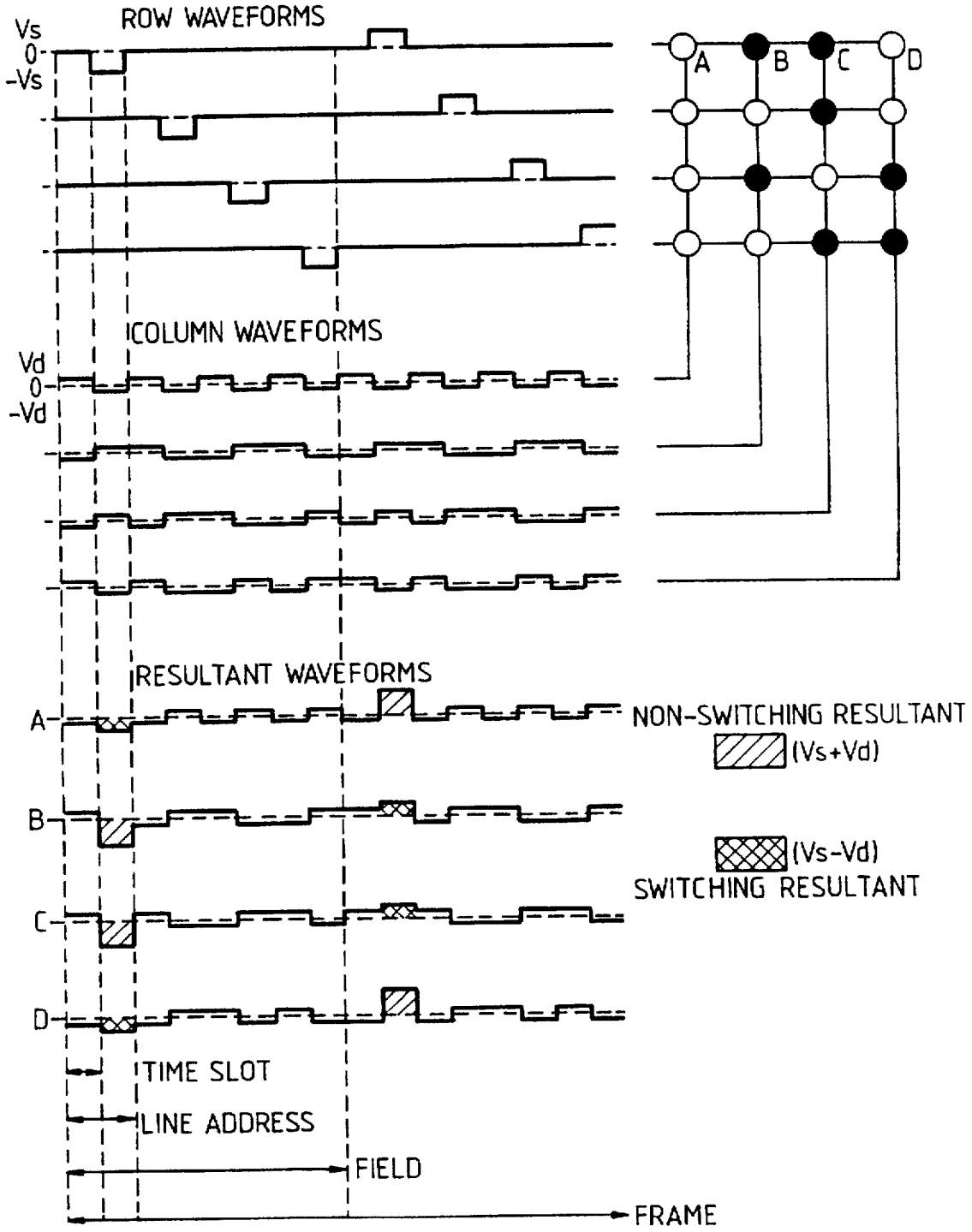
Fig. 7. PRIOR ART
FIGS. 7 and 13 are prior art waveform diagrams showing strobe and data pulses used in addressing an x, y matrix display.

FIG. 7 shows waveforms used in a prior art addressing scheme to switch a four row by four column array. As shown open circles may be defined as OFF pixels and solid circles as ON pixels.

A strobe waveform is applied to each of rows R1 to R4 in turn and comprises a zero for one time slot ts followed by a dc pulse of −Vs for one time slot; rows not receiving the strobe pulse receive a zero voltage. Thus for row R1 the applied waveform is zero volts in ts1, −Vs in ts2, followed by zero volts for the time slots ts3 to ts8. The time ts1 to ts8 is termed a field time and is equal to N×2 ts, where N is the number of lines in a display. For row R2 the applied waveform is zero in ts1, ts2, then the strobe waveform of zero volts in ts3 and −Vs in ts4, and zero volts for the remainder of the frame, ie ts5 to ts8. Similarly for rows R3 and R4 the strobe waveform is applied during ts5, ts6 and ts7, ts8 respectively with zero volts at the other time slots.

The opposite is then applied for a further field, namely a zero for one ts, a +Vs for one ts, and zero for the remainder of the field time. Two fields are necessary to completely switch the array and this time is termed the frame time; displays are continually addressed by successive frame. The first field (or odd number of field) switches all required pixels to the ON state and the second field (or even number of field) switches all required pixels to the OFF state.

The waveforms applied to the columns are termed data ON and data OFF waveforms; each comprises alternate pulses of +/−Vd with a pulse length of ts. The data ON and data OFF are of opposite sign.

The resultant of strobe pulses and data pulses at pixels marked as A, B, C, D are shown and are termed resultant waveforms. The resultant waveforms are the voltage levels across the liquid crystal material. Pulses marked with a single hatching, of amplitude Vs+Vd and length do not switch the material. Pulses marked with (double) cross hatching, of amplitude Vs–Vd, switch the material when operating in the v.t minimum mode (FIG. 5). As shown pixels A and D switch in the first field whilst those marked B, C switch in the second field.

In the prior art scheme shown by FIG. 7 the value of Vs is 5 Vd. Typically Vs=50 volts. Addressing schemes of the present invention use strobe and data waveforms with approximately equal maximum voltage levels yet apply similar peak resultant voltages to the liquid crystal material. The effect of this is to reduce the voltage requirements on the driver circuits allowing components presently used in multiplex rms addressing field effect liquid crystal displays to be used in addressing FLCDs.

In the following FIGS. 7 to 12 and 14 to 20 various prior art addressing schemes are modified by additional waveforms applied to both strobe and data waveforms to provide lower voltage levels at the drivers.

Figure 8:
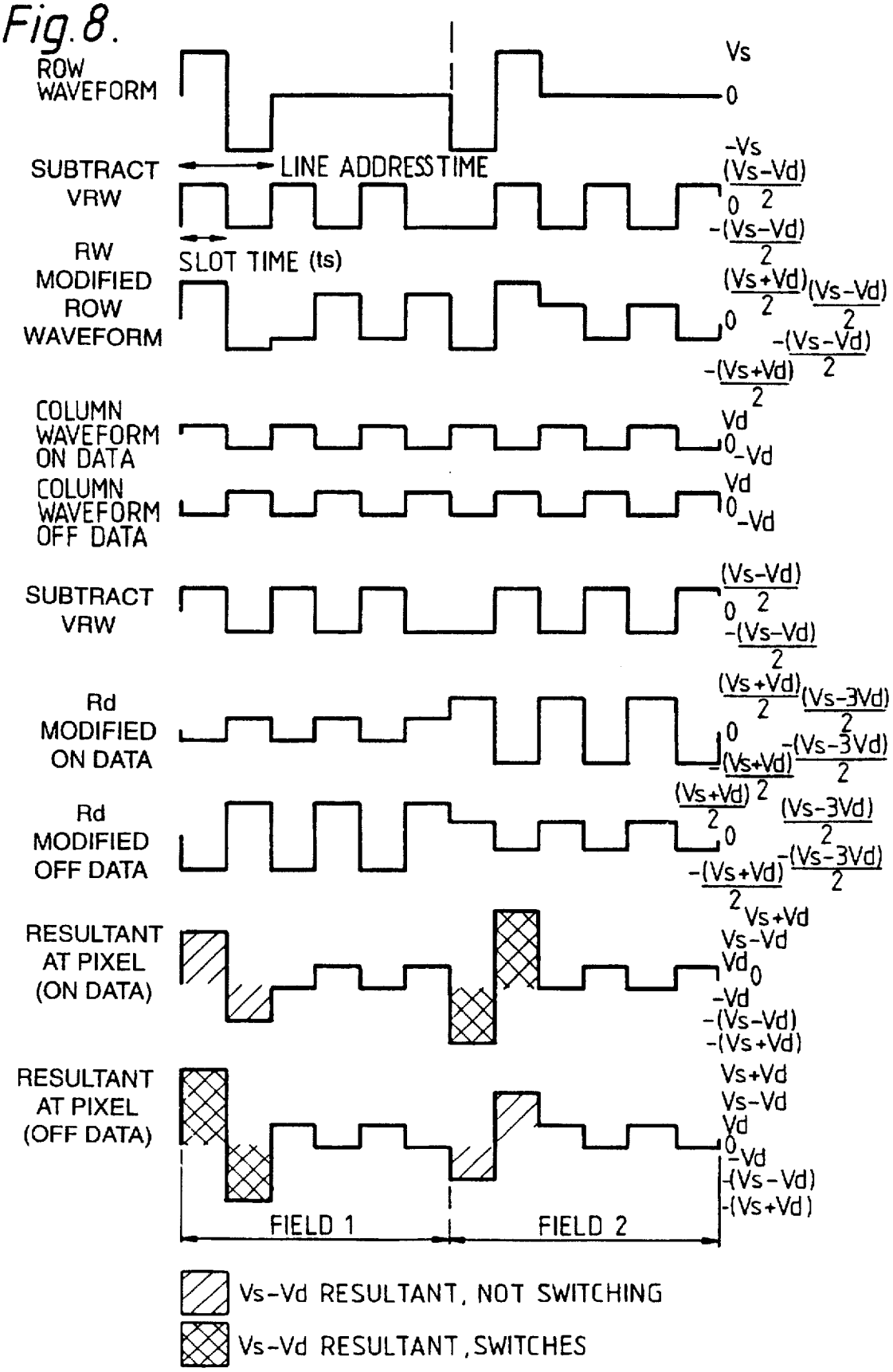

FIG. 8 shows a strobe waveform having balanced strobe pulses of first a +Vs for one time slot ts immediately followed by –Vs for one ts for the first field. Polarity is reversed, and in the second field the strobe is –Vs followed by +Vs. Line address time is 2 ts.

A voltage reduction waveform, VRW, comprises pulses of +(Vs–Vd)/2 for ts followed by –(Vs–Vd)/2 for ts alternately for one field. Polarity is reversed for the second field.

The resultant waveform for each row Rw is the difference between strobe waveform and the VRW. This gives the waveform shown which has four voltages levels +(Vs+Vd)/2, +(Vs–Vd)/2, –(Vs–Vd)/2, and –(Vs+Vd)/2.

The basic data waveforms ON DATA and OFF DATA are alternate pulses of +/–Vd in each time slot ts. Again a VRW is alternate pulses of +/–(Vs–Vd)/2. The resultant data waveforms Rd applied to each column, are waveforms with four voltage levels of +(Vs+Vd)/2, +(Vs–3 Vd)/2, –(Vs–3 Vd)/2, and –(Vs+Vd)/2.

The resultant waveform at a pixel is the combination of Rw and Rd which has exactly the same waveform, both shape and amplitude, as if the strobe and data waveforms alone had been applied. The result is correct switching as required, but with the maximum voltage applied by a driver reduced from Vs to (Vs+Vd)/2; in a typical case this may be a reduction from 50 to 30 volts, where Vs=50 volts and Vd=10 volts.

FIG. 9 shows waveforms for addressing the first line in a modified monopulse address scheme. The strobe waveform is first a zero voltage in the first ts followed by a single pulse of –Vs in the second time slot, and then zero pulses in the time slots remaining in the first field. In the second field the strobe pulse is +Vs. A row voltage reduction waveform is a single level of –(Vs–Vd)/2 for N×2 ts for the first field and (Vs–Vd)/2 for the second field. The resultant row waveform has four voltage levels, (Vs–Vd)/2, –(Vs+Vd)/2, –(Vs–Vd)/2, and +(Vs+Vd)/2.

Data waveforms are as in FIG. 7, alternate pulse of +/–Vd. The data VRW is a –(Vs–Vd)/2 in the first field and +(Vs–Vd)/2 in the second field. The resultant data ON and OFF waveforms have four voltage levels +(Vs+Vd)/2, +(Vs–3 Vd)/2, –(Vs–3 Vd)/2, and –(Vs+Vd)/2.

Resultant waveforms at a pixel are the same values as would be obtained without the strobe and data VRW being employed.

Figure 10:
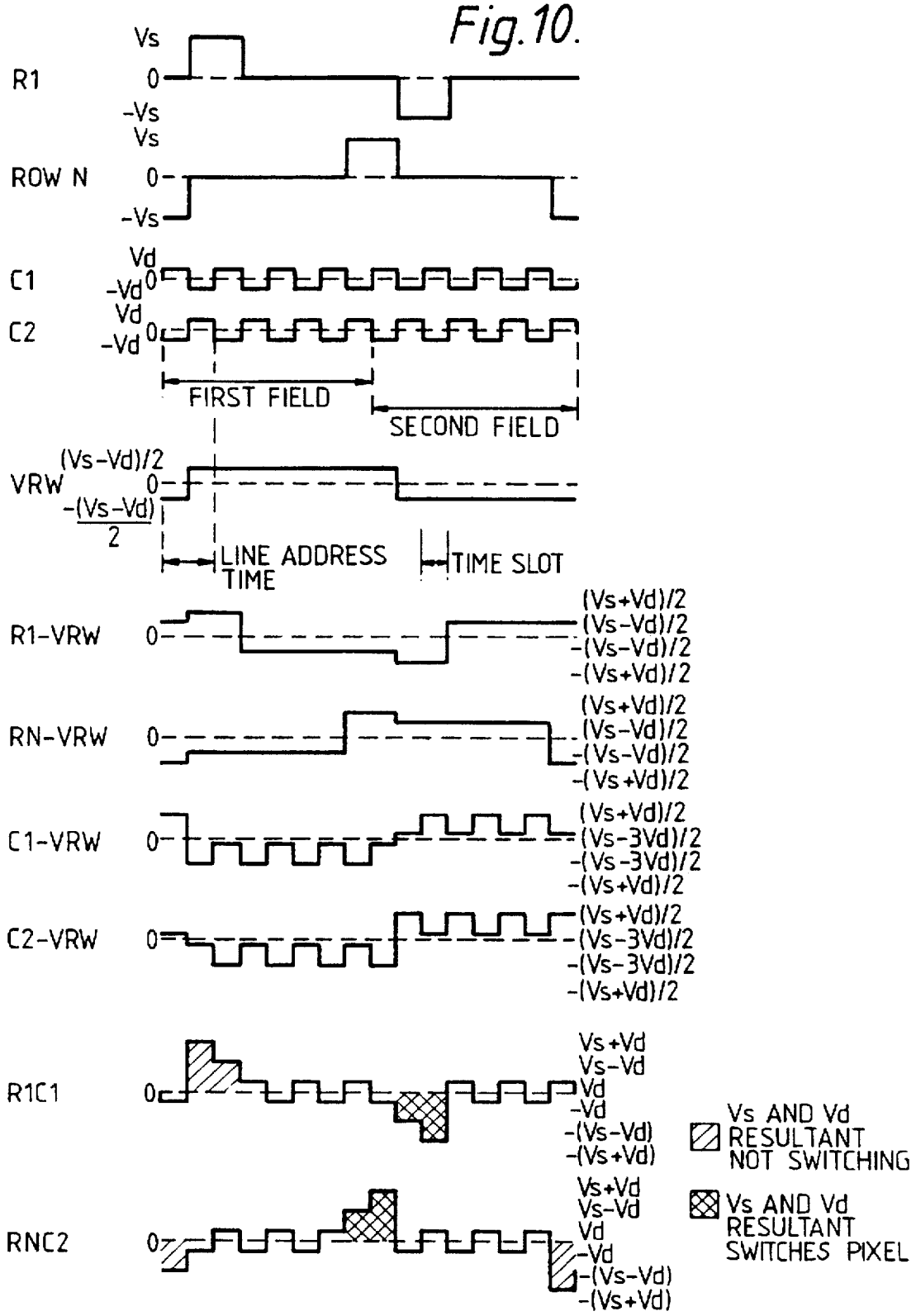

FIG. 10 shows waveforms for addressing the first and fourth line in an addressing scheme modified from that described in GB9017316.

The basic strobe waveform is a zero for the first ts then +Vs for the second ts. In this particular scheme the +Vs pulse is extended for a further ts whilst the start of the strobe waveform is applied to the second row. The reason the strobe waveform starts with a zero pulse is that each pixel is addressed by the resultant of the first (zero) and second (non-zero) strobes pulses in combination with the first and second data pulses. As explained in GB 9017316, whether or not a larger pulse switches depends upon the amplitude and sign of the preceeding smaller pulse. A strobe VRW is –(Vs–Vd)/2 for the first ts followed by +(Vs–Vd)/2 for the remainder of the first field. In the second field the polarity is inverted. The resultant strobe waveform is shown for rows 1 and 4; it has the same four voltages levels as FIG. 9.

Basic data ON and OFF are alternate pulses of Vd opposite polarity; data ON is the inverse of data OFF. The data VRW is the same as the strobe VRW. The resultant data ON and OFF waveforms are as shown with four voltage levels as in FIG. 9.

Resultant waveforms at a pixel are the same values as would be obtained without the strobe and data VRW being employed.

Figure 11:
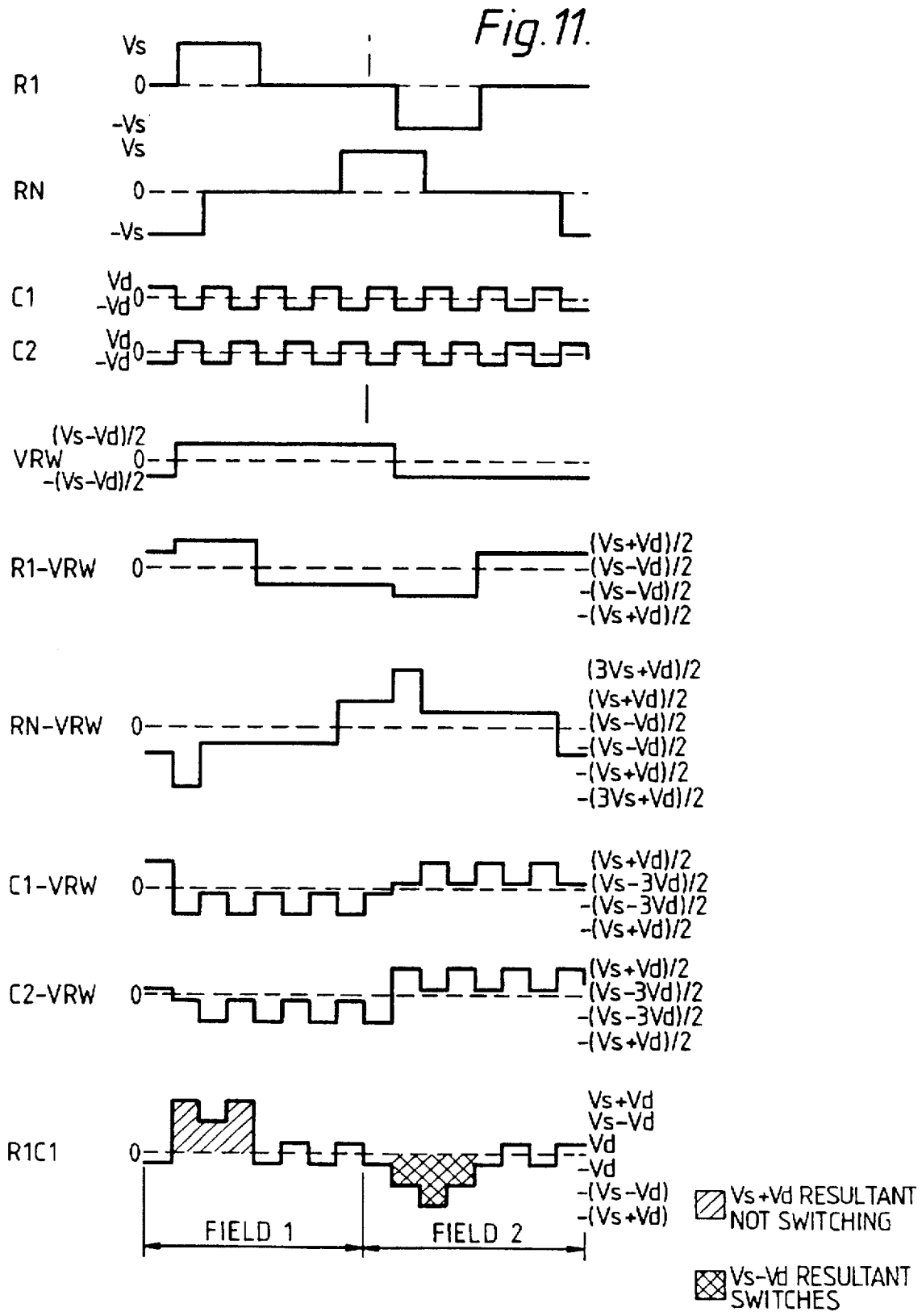

FIG. 11 is similar to FIG. 10 except that the strobe pulse of Vs is further extended into the address time of the next row. The strobe and data VRW are as in FIG. 10. Strobe, data, and pixel resultant waveforms are as shown. Again waveforms at a pixel are the same values as would be obtained without the strobe and data VRW being employed. Due to the length of the strobe pulse, the VRW can not accommodate this and so it is necessary to have a dummy line, ie the display will be N lines but only N-1 may be used.

In the above examples, FIGS. 8 to 11, the VRW was of amplitude (Vs–Vd)/2. As an alternative the amplitude could have been Vs/2, resulting in a higher peak to peak column voltage of Vs+2 Vd. Two such examples of this are shown in FIG. 12 which has basic strobe and data waveforms identical to those of FIG. 9.

Figure 12:
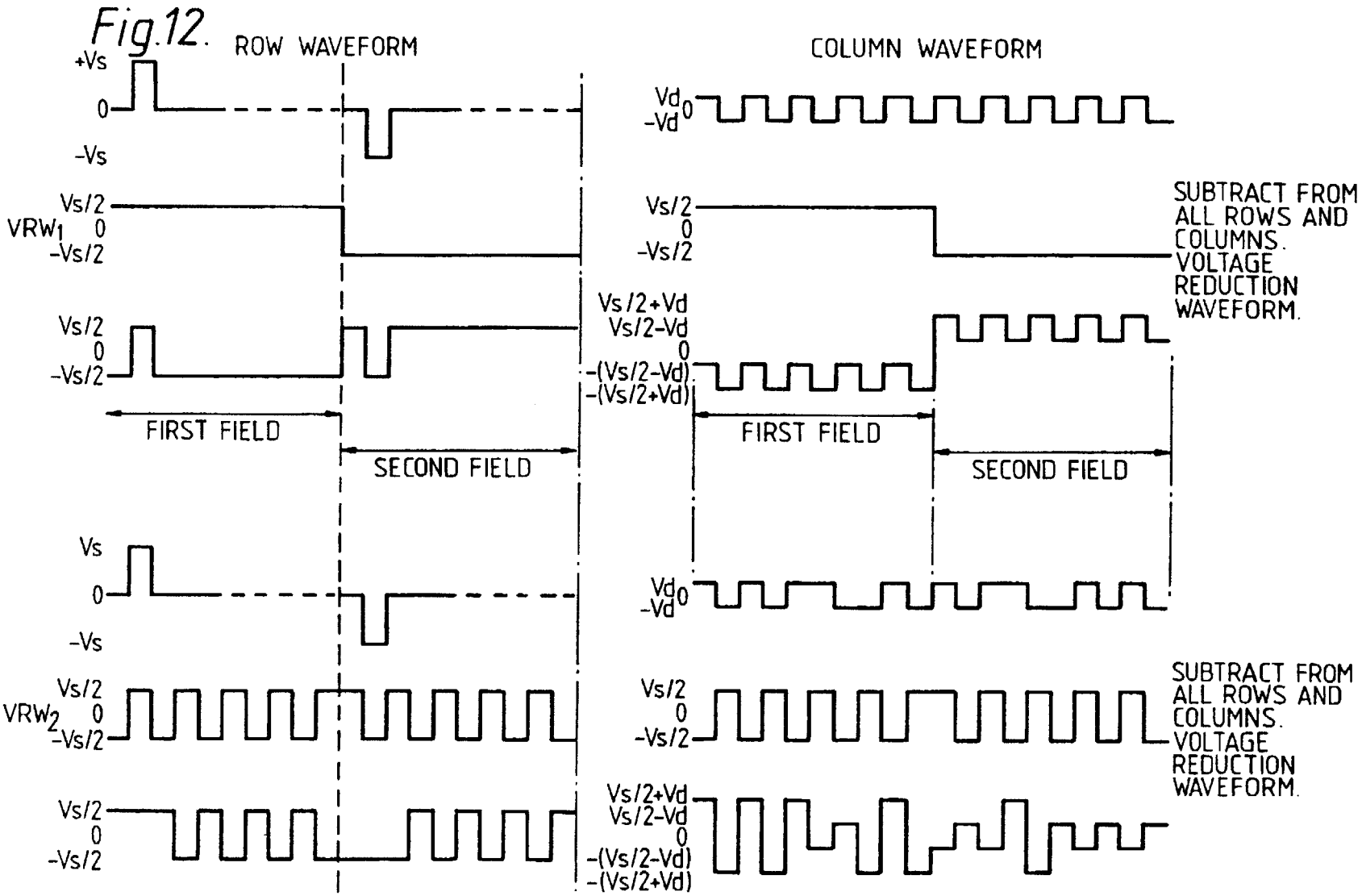

The first example in FIG. 12 has a VRW identical to that in FIG. 9 but with an amplitude of +and–Vs/2. The resultant strobe waveform has two voltage levels of +Vs/2 and –Vs/2. The resultant data waveform has four voltage levels of +(Vs/2)+Vd, (Vs/2)–Vd, –((Vs/2)–Vd), and –((Vs/2)+Vd).

The second example in FIG. 12 has data waveforms having pulses of +/–Vs/2 with each pulse lasting one ts. The shape of the resultant strobe and data waveforms are different from the first example in FIG. 12, but the number and values of the voltage levels is unchanged.

The above examples shown in FIGS. 8–12 employ strobe pulses of opposite polarity and address a complete display in two field making one frame. A known alternative addressing scheme employs a strobe blanking pulse followed by a switching pulse. The blanking pulse is arranged to be of sufficient amplitude and width that it always switches a pixel. The following strobe pulse selectively switches those pixels needing to be in a different state than that switched by the blanking pulse. An advantage of blanking pulse schemes is that the whole display is addressed by a single scan of the strobe waveforms, thereby halving the display address time. The blanking can be done on a line by line basis, the most common, a block of lines at a time, or the whole display (a whole page) at a time.

Figure 13:
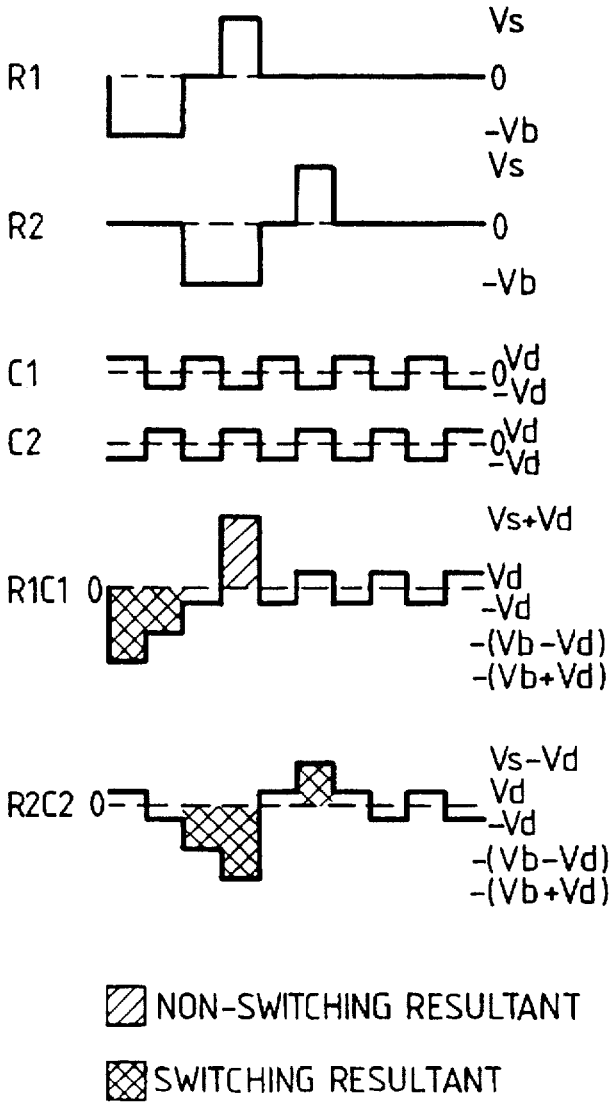
Fig. 13. PRIOR ART

FIG. 13 shows a prior art addressing scheme employing blanking pulses; it does not have any voltage reduction waveforms. The strobe waveform for row R1 comprises a blanking pulse of amplitude –Vb for a time of 2 ts. The selective switching strobe is first a zero voltage for one ts followed by +Vs for one ts. The line blanking time and line addressing time is 2 ts. Also shown is the strobe waveform applied to row R2.

Data ON and data OFF waveforms are alternate pulses of +/−Vd each lasting ts. Resultant waveforms at pixels required to be ON and OFF are shown for row 1 column 1 (R1C1) and R2C2. In R1C1 the blanking pulse has switched pixels but the strobe in ts4 has not reversed the state. In R2C2 the pixels have been switched by the blanking pulse, then switched to the opposite state by the strobe pulses.

The blanking pulse and strobe pulse do not usually balance; therefore the row waveform polarity is periodically reversed to maintain d.c balance.

Figure 14:
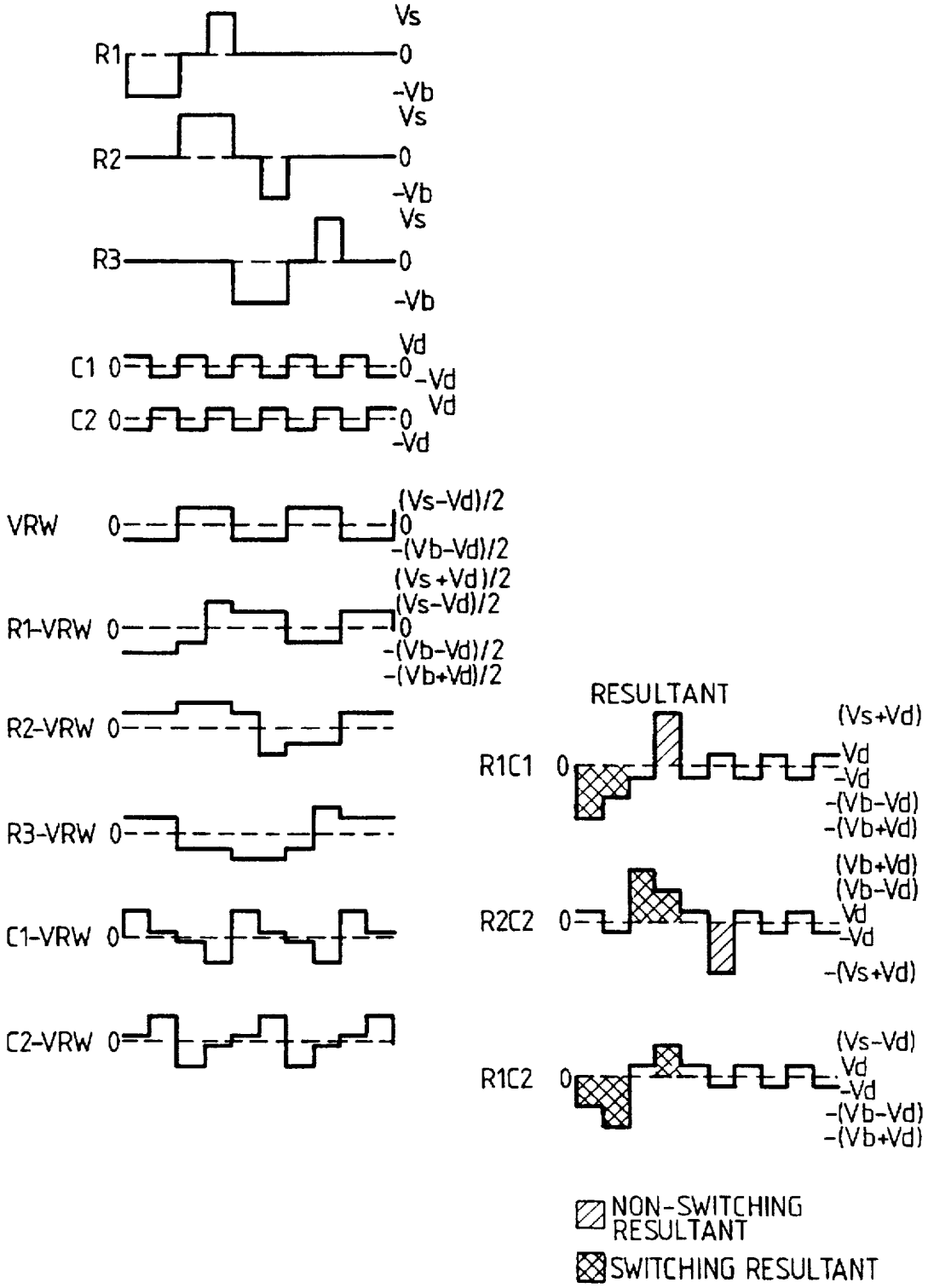

FIG. 14 shows a blanked monostrobe addressing scheme with VRW. Additionally alternate rows have polarity reversal in the strobe waveform. Furthermore the strobe waveforms are polarity inverted, eg in alternate frames to give a net zero dc. To preserve the single polarity excursions of the row waveform when the blanking pulse extends into the previous field it is necessary to have an even number of rows. To preserve the single polarity excursions of the row waveform it is necessary for the blanking pulse to precede the strobe pulse by an odd number of rows.

Strobe waveforms for rows R1, R2, R3 are shown; they are similar to those of FIG. 13 but with a polarity reversal in R2. The R1 blanking pulse is −Vb for 2 ts, followed by a zero for one ts then +Vs for one ts.

Data ON and data OFF waveforms are as in FIG. 13 and comprise alternate pulses of +/−Vd each lasting ts.

A VRW comprises −(Vb−Vd)/2 for 2 ts and (Vs−Vd)/2 alternately. The resultant row waveforms Rs and resultant column waveforms Rd are shown for R1, R2, R3, C1, and C2. Each resultant strobe and data waveform has four amplitude levels of (Vs+Vd)/2, (Vs−Vd)/2, −(Vb−Vd)/2, −(Vb+Vd)/2. Resultant waveforms at pixels R1C1, R2C2, R1C2 are shown; their shape is the same as those in FIG. 13. Therefore the display switches in the same manner as that of FIG. 13 but with lower peak voltages in the row drivers.

Figure 15:
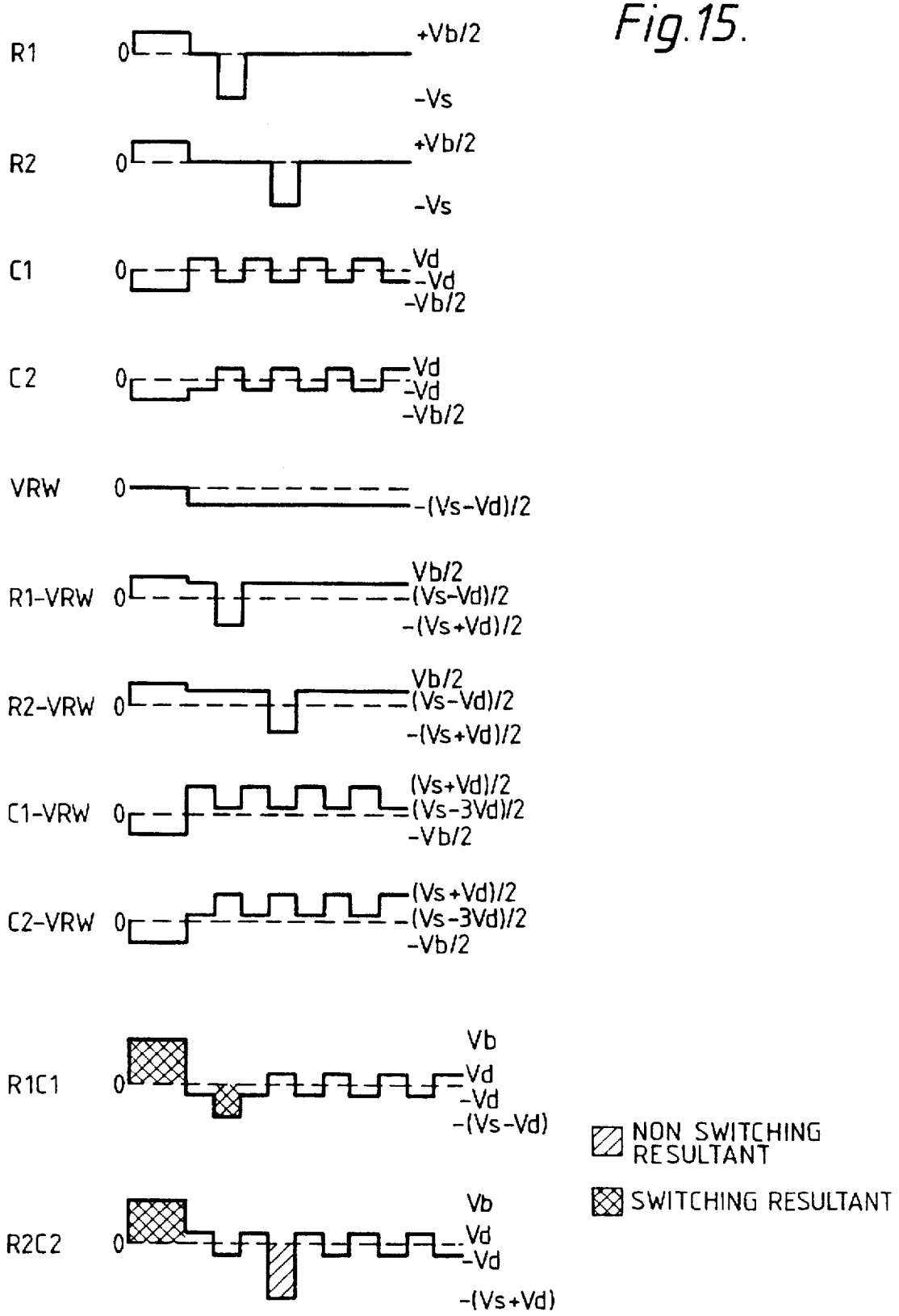

FIG. 15 shows an addressing scheme where a whole page is blanked to OFF at the same time, then selected pixels switched to ON. The strobe waveform is shown for R1, R2. All strobe waveforms have a blanking pulse of Vb/2 applied in time slots ts1 and ts2 which switches all pixels to one state. A strobe pulse of zero for one ts and then −Vs for one ts is then applied to each row in turn. Data ON and data OFF waveforms are −Vb/2 in time slots ts1 and ts2, then alternate pulses of +/−Vd of width one ts. A VRW has zero voltage for time slots ts1, ts2, then a constant −(Vs−Vd)/2 for the remainder of the field. Resultant strobe and data waveforms are shown for R1, R2, C1, C2.

Resultant voltages at pixels R1C1 and R2C2 are shown; again the voltages are the same as if the VRW had not been applied to strobe and data waveforms. Both pixels switch during ts1, ts2 whilst the blanking level of +Vb is applied. Pixel R1C1 switches during ts4 during application of −(Vs−Vd) because it is immediately preceeded by −Vd. In contrast pixel R2C2 does not switch during ts6 whilst receiving −(Vs+Vd) because it is immediately preceeded by +Vd.

The scheme shown in FIG. 15 is unsuitable for displays which are frequently updated because of the recurring blank screen. The concept can be extended to counter this problem by blanking a block of lines at a time. These would be selected by applying a +Vb/2, during a blanking period, to those rows to be blanked and −Vb/2 to all other rows, all columns receive −Vb/2. The concept can be thus further extended to blank line by line by introducing a blanking period between every line address period.

Figure 16:
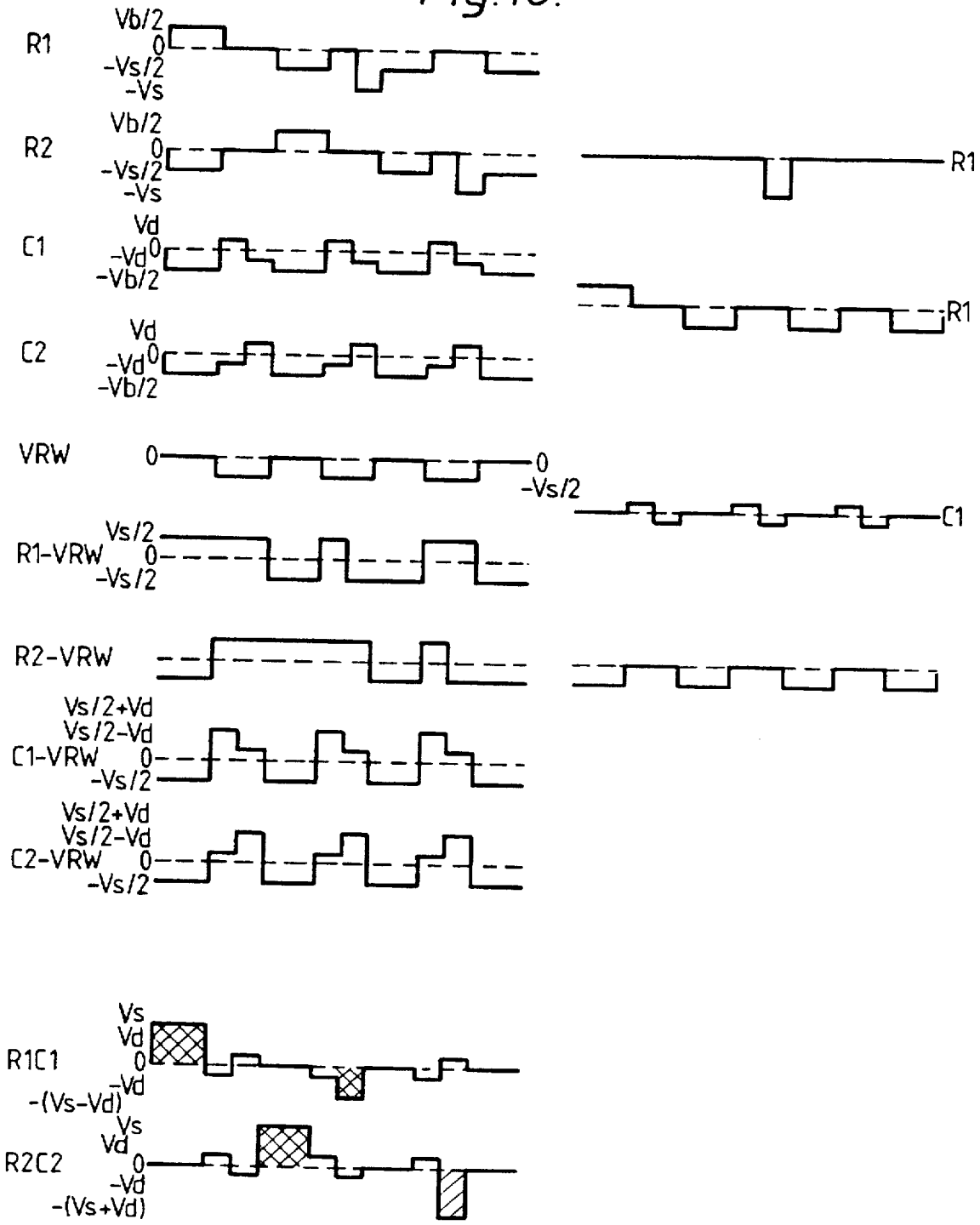

FIG. 16 shows a line blanking scheme. In this the basic strobe waveform is a conventional monostrobe waveform at alternate line address periods, at ts3, ts4, ts7, ts8, . . . etc. Between times the basic strobe waveform is a blanking waveform of +/−Vb/2 for 2 ts in time slots ts1, ts2, ts5, ts6 . . . etc; Vb=Vs. Similarly the basic data ON and data OFF waveforms are twin pulses of +/−Vd in time slot ts3, ts4, ts7, ts8, . . . etc. Between time the data waveforms are blanking pulses of Vb/2 during time slots ts1, ts2, ts5, ts6, . . . etc.

Basic strobe data waveforms are shown for R1, R2, C1, C2. A VRW has a voltage of −Vs/2 for pairs of time slots ts3, ts4, ts7, ts8 . . . etc. The resultant strobe waveform has two voltage levels, +/−Vs/2. The resultant data waveforms have three voltages levels, (Vs/2)+Vd, (Vs/2)−Vd, −Vs/2. Resultant waveforms at pixels R1C1 and R2C2 are shown.

The scheme of FIG. 16 provides a reduction in row peak voltage from 3 Vs/2 to 2 Vs, and column voltage peak of Vs+Vd. This is of benefit providing 3 Vs/2>Vs+Vd, ie Vs>2 Vd. As an alternative, the VRW amplitude may be −(Vs−Vd)/2.

The line by line blanking of FIG. 16 results in an overall doubling of the frame time when all the blanking periods are taken into account. There is therefore no speed improvement over the two-field case of FIG. 12. It does have application though for the cases previously referred to where a single polarity blanking pulse is required. This could be achieved in the example of FIG. 16 by making the blanking pulse amplitude Vs/2 thus removing the need to periodically invert all row polarities to maintain d.c. balance.

Figure 17:
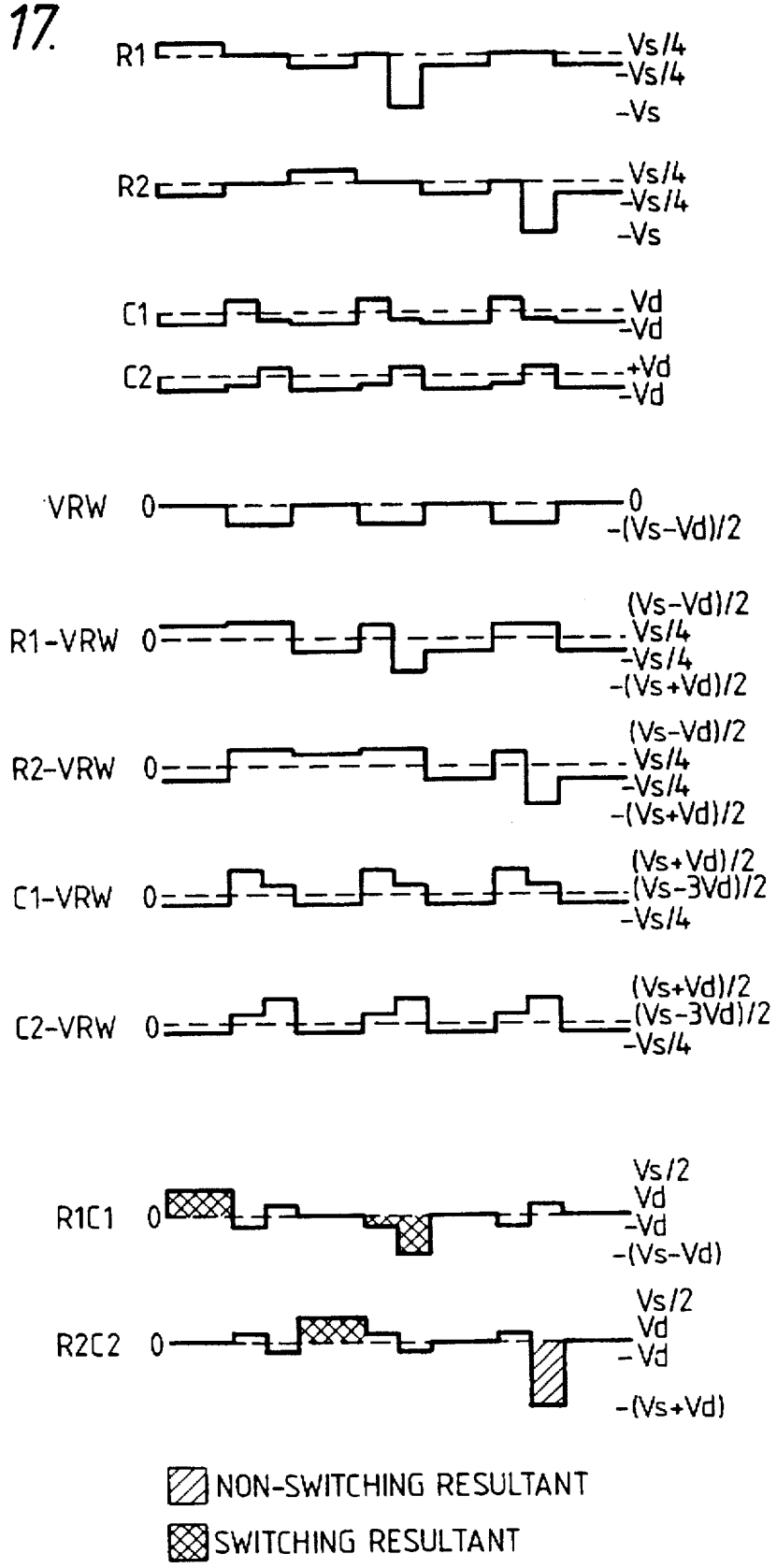

Such a scheme with blanking voltages of Vs/2 is shown in FIG. 17. Apart from the amplitude of blanking pulse the scheme of FIG. 17 is the same as in FIG. 16. The peak voltage for the rows is Vs, whilst that for the columns is 3 Vs/2+Vd/2.

A disadvantage of the schemes of FIG. 16, 17 is that there are many periods of zero volts in the resultant waveform at each pixel. This reduces the amount rms of a.c. voltages and hence the amount of a.c. stabilisation on the device. The technique of a.c. stabilisation is a known technique which improves the contrast observed between the ON and OFF states. Both amplitude and frequency contribute to a.c. stabilisation.

Figure 18:
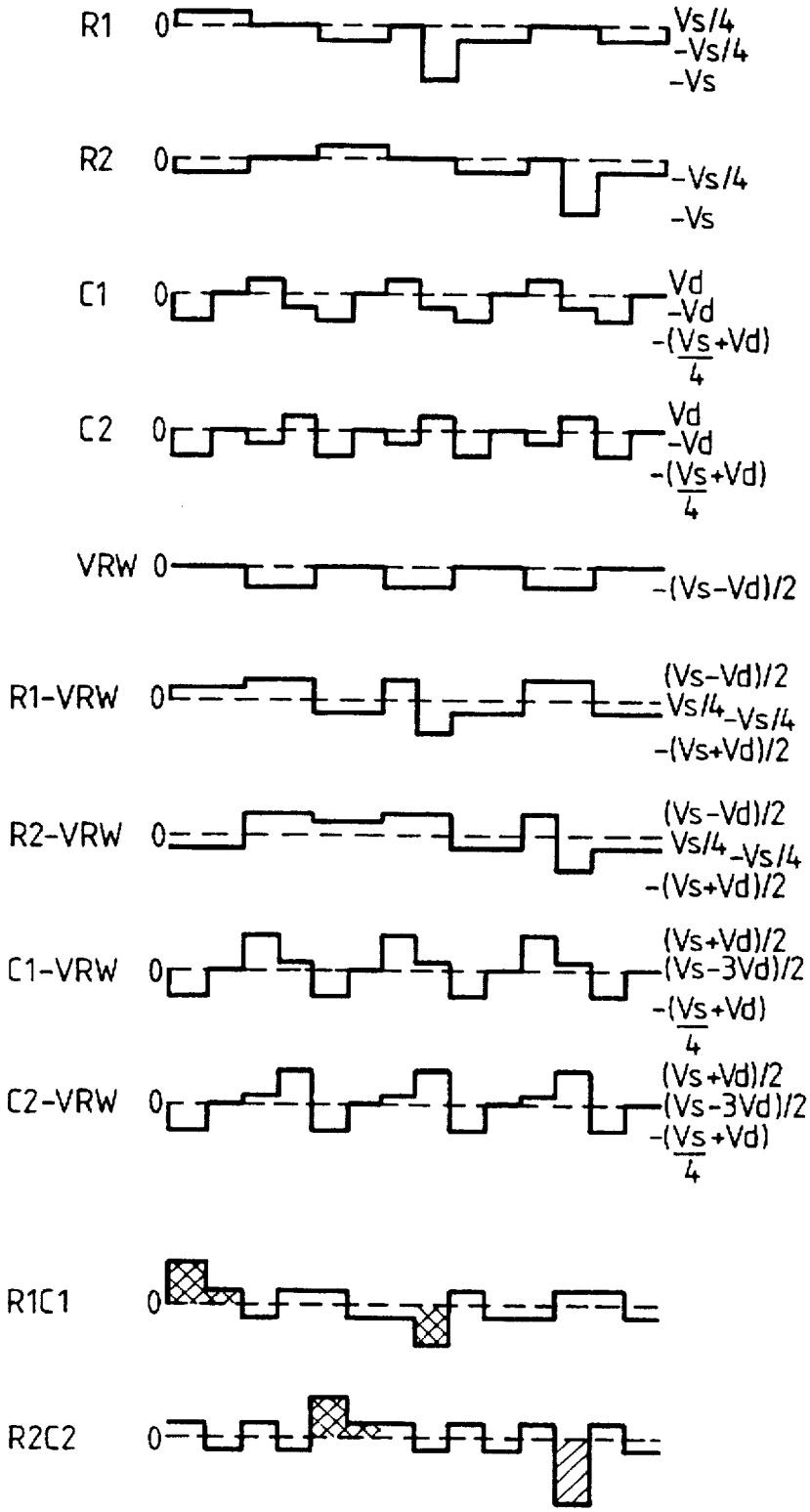
Figure 19:
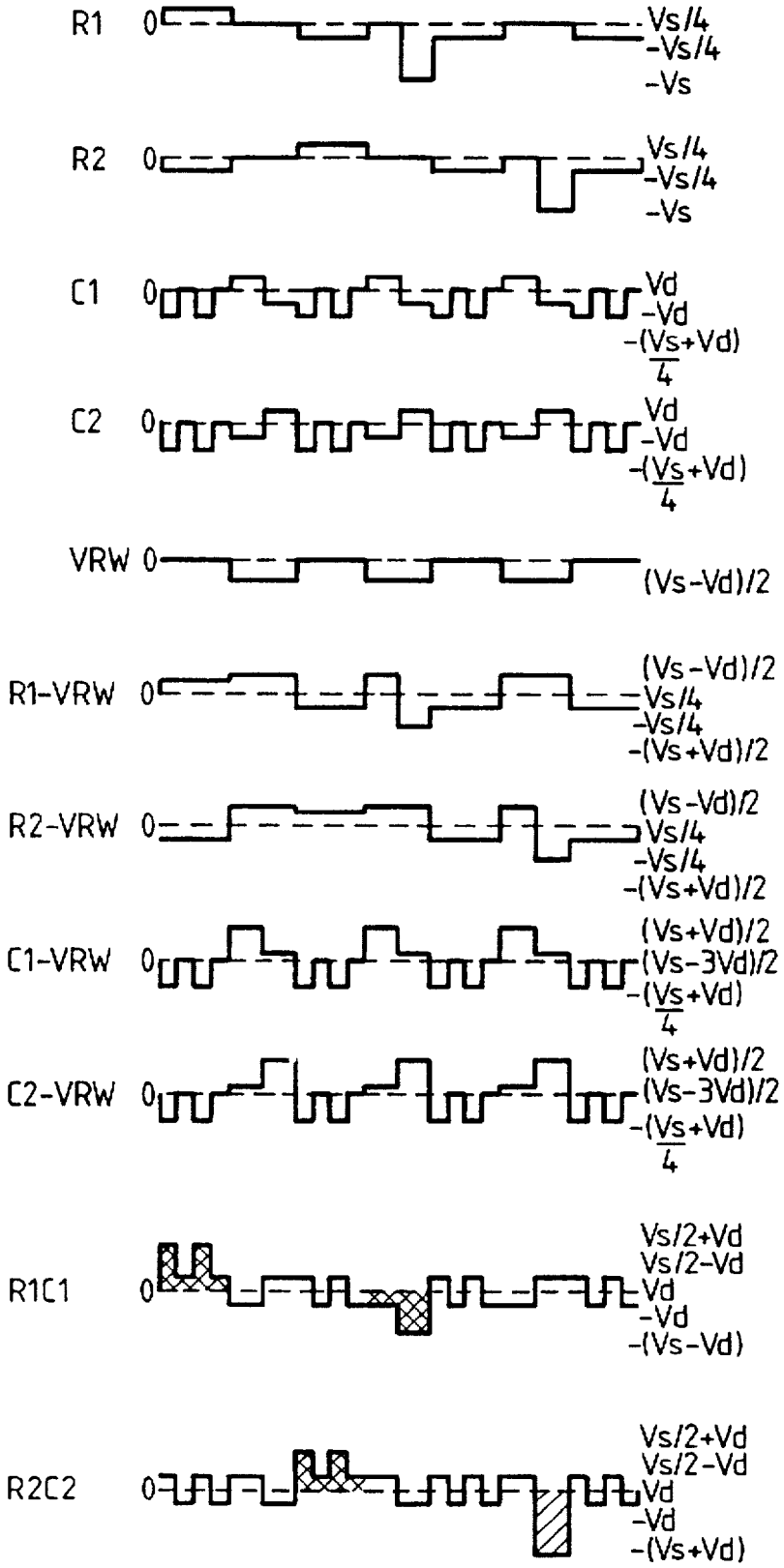

Improved a.c stabilisation can be provided by introducing an a.c. component into the blanking waveform as shown in FIGS. 18, 19. In FIG. 18 the data ON and data OFF have a pulse of −((Vs/4)+Vd) for one ts in slot periods ts1, ts5, ts9 . . . etc and a zero pulse in time slots ts2, ts6, ts10 . . . etc. Otherwise the data ON and OFF and the strobe waveform are as in FIG. 17. In the resultant pixel waveforms of FIG. 18 there are no time slot where a zero voltage appears. Thus a.c. stabilisation, and hence display contrast, is improved.

FIG. 19 differs from FIG. 18 in the shape of data ON and OFF waveforms. In FIG. 19 there are −((Vs/4)+Vd) pulses in the first half of ts1, ts2, ts5, ts6, ts9, ts10, . . . etc. Otherwise the strobe and data waveforms are as shown in FIG. 17. The resultant pixel waveforms are different from those of FIG. 17 and have a higher frequency a.c component.

Figure 6:
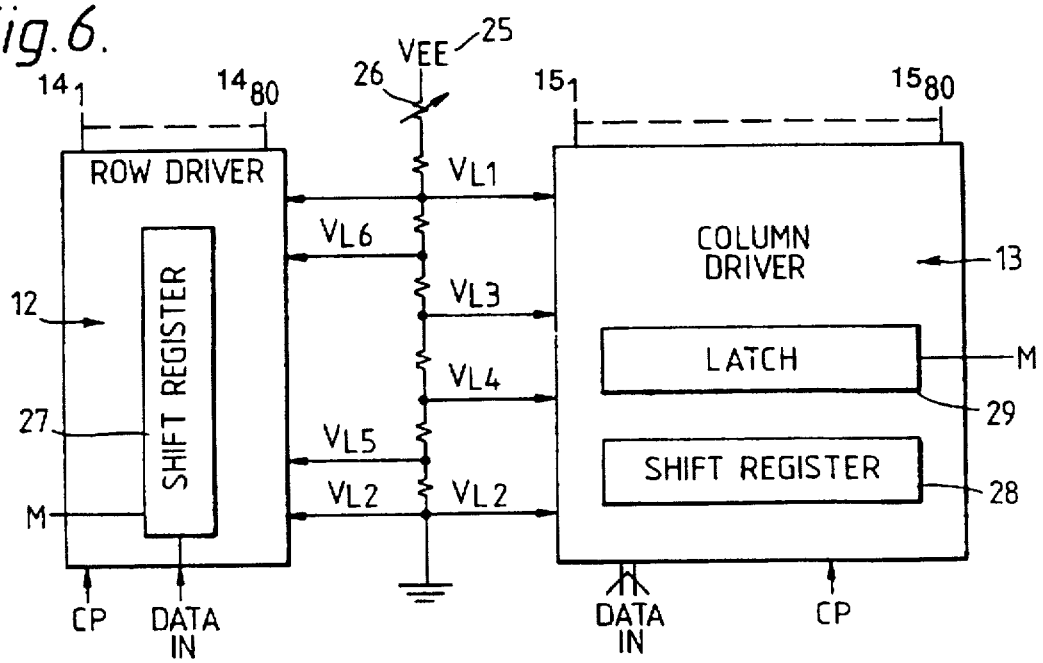
FIG. 6 is a block diagram of part of FIG. 1 showing inputs to and outputs from display driver circuits.

FIG. 6 shows a schematic view of row and column drivers 12, 13 supplied with different voltages from a resistive chain 25. This chain has a voltage supply Vee, a variable resistor 26 and a series of resistors all in series. Voltage outputs are VL1 to VL6.

The row driver shown is a Texas Instruments (RTM) TMS 3491 having inputs: cp, supplied by a clock at a maximum of 100 kHZ; Data in, a serial input of '0' and '1'; and a control input M. Additionally there are voltage level inputs of VL1, VL6, VL5, and VL2. There are 80 parallel outputs which connect to rows 14 to 80 of the cell 1. Inside the driver 12 is a serial-in, parallel-out shift register 27 which receives its input from DATA In and is clocked by Cl. Each stage of the shift register 27 connects to one of the outputs 14. The voltage appearing on a given output depends upon the value, a logic '0' or '1', plus the value of the signal M, a logic '0' or '1', as set out in the Truth Table 1 below.

The column driver 13 shown is a Texas Instruments (RTM) TMS 3492 having inputs: SC clocking at 6–5 MHz maximum; control M of logic '0' and '1'; Data in of 4-bit numbers; and four voltage levels VL1, VL3, VL4, VL2. There are 80 outputs 15 to the column electrodes of the cell 1. Within the driver 13 is a serial-in parallel-out 80 stage shift register 28 whose parallel outputs are fed into an 80 cell latch 29. Each cell of the latch 29 connects with one of the 80 outputs 15. The voltage appearing on a given output depends upon the value of the logic 0 or 1 in a latch cell, plus the logic value of M, as set out in the Truth Table 1 below.

TRUTH TABLE 1

| M | data | 3491 | 3492 |
|---|---|---|---|
| 1 | 1 | VL2 | VL1 |
| 1 | 0 | VL6 | VL3 |
| 0 | 1 | VL1 | VL2 |
| 0 | 0 | VL5 | VL4 |

Practical considerations of these driver chips give a maximum voltage of 40 volts.

An example of available voltage levels is:

| | | |
|---|---|---|
| VL1 | +(Vs + Vd)/2 | +20 v |
| VL6 | +(Vs − Vd)/2 | +16.5 v |
| VL3 | +(Vs − 3Vd)/2 | +13 v |
| VL4 | −(Vs − 3Vd)/2 | −13 v |
| VL5 | −(Vs − Vd)/2 | −16.5 v |
| VL2 | −(Vs + Vd)/2 | −20 v |

Operation of the drivers 12, 13, to display the pattern seen on FIG. 7 namely a 4×4 array, by the scheme shown in FIG. 8 will now be described. The pattern to be displayed is that the following pixels should be in a DOWN state: R1C2, R1C3, R2C3, R3C2, R3C4, R4C3, R4C4; all other pixels are in an UP state. The designations R1C2, etc. refer to row 1, column 2, etc. in the 4 row by 4 column array. The terms DOWN and UP are arbitrary, but correspond with switching by negative and positive pulses respectively.

Figure 20:
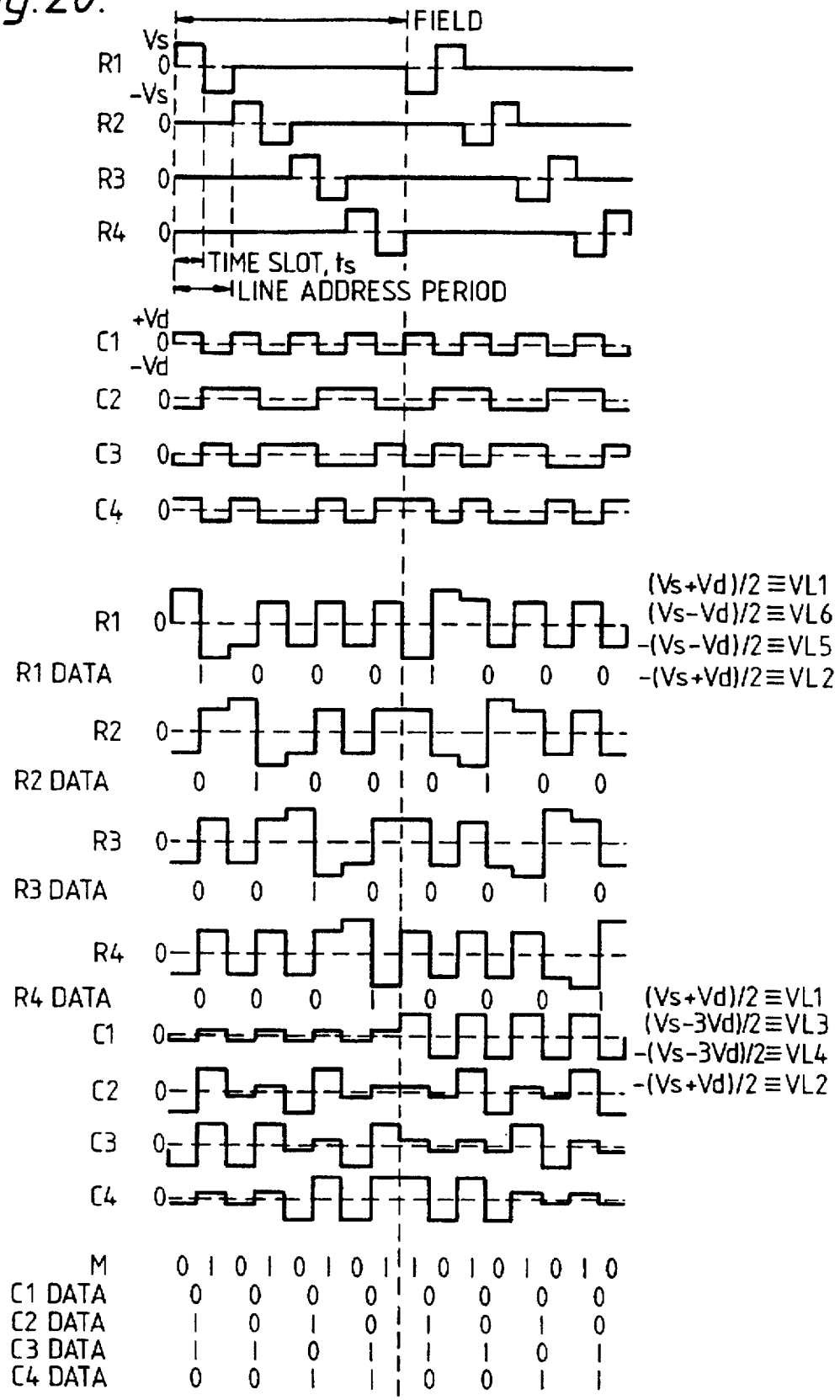

FIG. 20 shows basic row and column waveforms, and those basic waveforms as modified by the VRW seen in FIG. 8. As seen more clearly in the basic row waveforms a pair of strobe pulses, of time length 2 ts=a line address period, is applied to each row R1 to R4 in turn. During each line address period the required data UP or data DOWN waveform must be applied to each column C1 to C4 to switch pixels in that line being addressed.

Assume both row and column drivers 12, 13 have been preloaded with logic 0 throughout. The number 0110 is loaded into shift register of the column driver 13; note this matches the pattern in row R1. The logic 1 is loaded into shift register of the row driver 12, and simultaneously the contents of the column shift register transferred into the latch 29. The logic states of the shift register stages corresponding to row outputs and latch stages corresponding to column outputs are:

| Electrode | 1 | 2 | 3 | 4 |
|---|---|---|---|---|
| Row | 1 | 0 | 0 | 0 |
| Column | 0 | 1 | 1 | 0 |

These logic values remain for the first line address period, ie time slots ts1, ts2. To produce two different voltage levels, one in ts1 and another in ts2, the value of control input M is changed between logic 0 and 1.

During this time the column shift register is loaded with data of-r the next (R2) line address, ie the number 0010. The logic 1 in the row shift register is clocked along one stage, and data in the column register transferred to the latch. The logic states of the shift register stages corresponding to row outputs and latch stages corresponding to column outputs are:

| Electrode | 1 | 2 | 3 | 4 |
|---|---|---|---|---|
| Row | 0 | 1 | 0 | 0 |
| Column | 0 | 0 | 1 | 0 |

Modulate M from 0 to 1 to produce two voltage levels at each driver output; this occurs in time slots ts3, ts4.

During this time ts3, ts4, the column shift register is loaded with data for the next line address, ie the number 0101. The logic 1 in the row shift register is clocked along one stage, and data in the column register transferred to the latch. The logic states of the shift register stages corresponding to row outputs and latch stages corresponding to column outputs are:

| Electrode | 1 | 2 | 3 | 4 |
|---|---|---|---|---|
| Row | 0 | 0 | 1 | 0 |
| Column | 0 | 1 | 0 | 1 |

Modulate M from 0 to 1 to produce two voltage levels at each driver output; this occurs in time slots ts5, ts6.

During this time ts5, ts6, the column shift register is loaded with data for the next line address, ie the number 0011. The logic 1 in the row shift register is clocked along one stage, and data in the column register transferred to the latch. The logic states of the shift register stages corresponding to row outputs and latch stages corresponding to column outputs are:

| Electrode | 1 | 2 | 3 | 4 |
|---|---|---|---|---|
| Row | 0 | 0 | 0 | 1 |
| Column | 0 | 0 | 1 | 1 |

Modulate M from 0 to 1 to produce two voltage levels at each driver output; this occurs in time slots ts7, ts8.

This sequence is repeated for the second field, but with the values of M inverted.

Tables 2 to 5 below show the values of input data D in each row driver shift register stage and column driver latch stage; the value of M; and the value of the row and column driver output (the VL number) during each time slot ts, both in the first and second fields. The first number in the table indicates the row being addressed.

TABLE 2

First field, logic values on rows R1 to R4

| | | R1 | | | R2 | | | R3 | | | R4 | | |
|---|---|---|---|---|---|---|---|---|---|---|---|---|---|
| Row | ts | M | D | VL | M | D | VL | M | D | VL | M | D | VL |
| 1 | 1 | 0 | 1 | 1 | 0 | 0 | 5 | 0 | 0 | 5 | 0 | 0 | 5 |
| 1 | 2 | 1 | 1 | 2 | 1 | 0 | 6 | 1 | 0 | 6 | 1 | 0 | 6 |
| 2 | 3 | 0 | 0 | 5 | 0 | 1 | 1 | 0 | 0 | 5 | 0 | 0 | 5 |
| 2 | 4 | 1 | 0 | 6 | 1 | 1 | 2 | 1 | 0 | 6 | 1 | 0 | 6 |
| 3 | 5 | 0 | 0 | 5 | 0 | 0 | 5 | 0 | 1 | 1 | 0 | 0 | 5 |
| 3 | 6 | 1 | 0 | 6 | 1 | 1 | 6 | 1 | 1 | 2 | 1 | 0 | 6 |
| 4 | 7 | 0 | 0 | 5 | 0 | 0 | 5 | 0 | 0 | 5 | 0 | 1 | 2 |
| 4 | 8 | 1 | 0 | 6 | 1 | 0 | 6 | 1 | 0 | 6 | 1 | 1 | 2 |

TABLE 3

Second field, logic values on rows R1 to R4

| | | R1 | | | R2 | | | R3 | | | R4 | | |
|---|---|---|---|---|---|---|---|---|---|---|---|---|---|
| Row | ts | M | D | VL | M | D | VL | M | D | VL | M | D | VL |
| 1 | 9 | 1 | 1 | 2 | 1 | 0 | 6 | 1 | 0 | 6 | 1 | 0 | 6 |
| 1 | 10 | 0 | 1 | 1 | 0 | 0 | 5 | 0 | 0 | 5 | 0 | 0 | 5 |
| 2 | 11 | 1 | 0 | 6 | 1 | 1 | 2 | 1 | 0 | 6 | 1 | 0 | 6 |
| 2 | 12 | 0 | 0 | 5 | 0 | 1 | 1 | 0 | 0 | 5 | 0 | 0 | 5 |
| 3 | 13 | 1 | 0 | 6 | 1 | 0 | 6 | 1 | 1 | 2 | 1 | 0 | 6 |
| 3 | 14 | 0 | 0 | 5 | 0 | 0 | 5 | 0 | 1 | 1 | 0 | 0 | 5 |
| 4 | 15 | 1 | 0 | 6 | 1 | 0 | 6 | 1 | 0 | 6 | 1 | 1 | 2 |
| 4 | 16 | 0 | 0 | 5 | 0 | 0 | 5 | 0 | 0 | 5 | 0 | 1 | 1 |

TABLE 4

First field, logic values on columns C1 to C4.

| | | Col 1 | | | Co. 2 | | | Col 3 | | | Col 4 | | |
|---|---|---|---|---|---|---|---|---|---|---|---|---|---|
| Row | ts | M | D | VL | M | D | VL | M | D | VL | M | D | VL |
| 1 | 1 | 0 | 0 | 4 | 0 | 1 | 2 | 0 | 1 | 2 | 0 | 0 | 4 |
| 1 | 2 | 1 | 0 | 3 | 1 | 1 | 1 | 1 | 1 | 1 | 1 | 0 | 3 |
| 2 | 3 | 0 | 0 | 4 | 0 | 0 | 4 | 0 | 1 | 2 | 0 | 0 | 4 |
| 2 | 4 | 1 | 0 | 3 | 1 | 0 | 3 | 1 | 1 | 1 | 1 | 0 | 3 |
| 3 | 5 | 0 | 0 | 4 | 0 | 1 | 2 | 0 | 0 | 4 | 0 | 1 | 2 |
| 3 | 6 | 1 | 0 | 3 | 1 | 1 | 1 | 1 | 0 | 3 | 1 | 1 | 1 |
| 4 | 7 | 0 | 0 | 4 | 0 | 0 | 4 | 0 | 1 | 2 | 0 | 1 | 2 |
| 4 | 8 | 1 | 0 | 3 | 1 | 0 | 3 | 1 | 1 | 1 | 1 | 1 | 1 |

TABLE 5

Second field, logic values on columns C1 to C4.

| | | Col 1 | | | Co. 2 | | | Col 3 | | | Col 4 | | |
|---|---|---|---|---|---|---|---|---|---|---|---|---|---|
| Row | ts | M | D | VL | M | D | VL | M | D | VL | M | D | VL |
| 1 | 9 | 1 | 0 | 1 | 1 | 1 | 3 | 1 | 1 | 3 | 1 | 0 | 1 |
| 1 | 10 | 0 | 0 | 2 | 0 | 1 | 4 | 0 | 1 | 4 | 0 | 0 | 2 |
| 2 | 11 | 1 | 0 | 1 | 1 | 0 | 1 | 1 | 1 | 3 | 1 | 0 | 1 |
| 2 | 12 | 0 | 0 | 2 | 0 | 0 | 2 | 0 | 1 | 4 | 0 | 0 | 2 |
| 3 | 13 | 1 | 0 | 1 | 1 | 1 | 3 | 1 | 0 | 1 | 1 | 1 | 3 |
| 3 | 14 | 0 | 0 | 2 | 0 | 1 | 4 | 0 | 0 | 2 | 0 | 1 | 4 |
| 4 | 15 | 1 | 0 | 1 | 1 | 0 | 1 | 1 | 1 | 3 | 1 | 1 | 3 |
| 4 | 16 | 0 | 0 | 2 | 0 | 0 | 2 | 0 | 1 | 4 | 0 | 1 | 4 |

The addressing schemes shown in FIGS. 7–20 may also be implemented in a similar manner to that shown the above tables 2–5.

We claim:

1. A multiplex addressed liquid crystal display comprising:

a liquid crystal cell including a layer of ferro-electric smectic liquid crystal material contained between two substrates, each substrate bearing a set of electrodes, said sets of electrodes arranged to form collectively a matrix of addressable display elements having addressable intersections;

means, responsive to a data waveform, a strobe waveform and a voltage reduction waveform, for generating modified data and modified strobe waveforms of unipolar pulses in successive time slots (ts) for applying to the, two sets of electrodes, said generating means combining a data waveform and a voltage reduction waveform to form said modified data waveform and for applying said modified data waveform to one set of electrodes, and combining said strobe waveform and said voltage reduction waveform to form said modified strobe waveform and for applying said modified strobe waveform to the other set of electrodes in a multiplexed manner, means for controlling the order of data waveforms so that a desired display pattern is obtained wherein voltage levels applied to the generating means are reduced whilst maintaining the resultant voltage level appearing at the addressable intersections.

2. The display of claim 1 wherein the generating means includes:

row driver circuits having at least three different voltage level inputs, two control inputs (DATA-IN, & M), a serial-in parallel-out multistage shift register having a separate stage associated with each row electrode whereby a row waveform of at least three different voltage levels may be applied to each row electrode in sequence, column driver circuits having at least three different voltage level inputs, two control inputs (DATA-IN, & M), a serial-in parallel-out multistage shift register, and a latch associated with each stage output, whereby a column waveform may be applied to each column electrode.

3. The display of claim 1 wherein the generating means is arranged to address the display by strobe pulses of opposite polarity in successive field times.

4. The display of claim 2 wherein the generating means is arranged to address the display by a blanking waveform of one polarity and a strobe pulse of opposite polarity.

5. The display of claim 2 wherein the row driver circuits have four different voltage level inputs, and the column driver circuits have four different level inputs.

6. The display of claim 2 wherein the row driver circuits have three different voltage level inputs and the column driver circuits have three different level inputs.

* * * * *